US011608210B2

(12) United States Patent
Savenok

(10) Patent No.: US 11,608,210 B2
(45) Date of Patent: Mar. 21, 2023

(54) LID-CAP COMBINATIONS FOR A CAN

(71) Applicant: Pavel Savenok, Wheaton, IL (US)

(72) Inventor: Pavel Savenok, Wheaton, IL (US)

(73) Assignee: Resolute Patents, LLC, Wheaton, IL (US)

( * ) Notice: Subject to any disclaimer, the term of this patent is extended or adjusted under 35 U.S.C. 154(b) by 0 days.

(21) Appl. No.: 17/327,610

(22) Filed: May 21, 2021

(65) Prior Publication Data

US 2021/0276760 A1 Sep. 9, 2021

Related U.S. Application Data

(63) Continuation-in-part of application No. PCT/US2020/030882, filed on Apr. 30, 2020, and a continuation-in-part of application No. 16/791,062, filed on Feb. 14, 2020, now Pat. No. 11,279,531.

(60) Provisional application No. 63/029,376, filed on May 22, 2020.

(51) Int. Cl.
*B65D 17/28* (2006.01)
*B65D 51/18* (2006.01)

(52) U.S. Cl.
CPC ..... *B65D 17/4014* (2018.01); *B65D 51/18* (2013.01); *B65D 2251/0009* (2013.01); *B65D 2251/0071* (2013.01); *B65D 2517/0041* (2013.01)

(58) Field of Classification Search
CPC .. B65D 51/007; B65D 43/0212; B65D 43/24; B65D 47/08; B65D 2251/0018; B65D 2251/0028; B65D 2251/0071; B65D 17/4014; B65D 51/18; B65D 2251/0009
USPC ..... 220/254.3, 253, 254.8
See application file for complete search history.

(56) References Cited

U.S. PATENT DOCUMENTS 6,073,797 A * 6/2000 Barous ..... B65D 43/0212 220/780
6,158,608 A * 12/2000 Schlattl ..... C23D 5/02 220/253
6,588,617 B1 * 7/2003 Majcen ..... B65D 17/4014 220/258.2
2001/0019058 A1 * 9/2001 Song ..... B65D 51/007 220/730
2003/0222083 A1 * 12/2003 Pladsbjerg ..... B65D 17/4012 220/258.2

(Continued)

*Primary Examiner* — J. Gregory Pickett
*Assistant Examiner* — Niki M Eloshway
(74) *Attorney, Agent, or Firm* — Christopher J. Scott

(57) ABSTRACT

Lid caps outfit lid assemblies thereby providing lid-cap combinations for beverage cans. The lid assemblies include a lid rim portion, a lid capping plate, and a can opener element and are attached to a lower can body for forming a beverage can. The lid caps include a cap plate centrally located relative to an outer cap periphery. A cap groove is configured to firstly attach the lid cap to the lid assembly by mated engagement, and may include a pivot structure for providing a can-opening access aperture and closing the can-opening access aperture. In certain embodiments, the cap plate includes a fastener-letting aperture. The can opener element is attached to the lid capping plate via a fastener as extended through the fastener-letting aperture thereby sandwiching the cap plate intermediate the can opener element and the lid capping plate for secondly attaching the lid cap to the lid assembly.

14 Claims, 25 Drawing Sheets

(56) References Cited

U.S. PATENT DOCUMENTS

| | | | | |
|---|---|---|---|---|
| 2004/0226951 | A1* | 11/2004 | Talmon | B65D 51/20 220/270 |
| 2007/0164027 | A1* | 7/2007 | Auer | B65D 47/0847 220/784 |
| 2008/0078763 | A1* | 4/2008 | Auer | B65D 47/0847 220/254.3 |
| 2015/0197366 | A1* | 7/2015 | Chapin | B65D 85/72 220/254.1 |
| 2019/0061996 | A1* | 2/2019 | Biasizzo | B65D 17/4014 |
| 2019/0177052 | A1* | 6/2019 | Battaglia | B65D 51/007 |
| 2020/0262621 | A1* | 8/2020 | Savenok | B65D 43/0212 |

* cited by examiner

LID-CAP COMBINATIONS FOR A CAN

PRIOR HISTORY

This application is a continuation-in-part patent application claiming the benefit of pending U.S. patent application Ser. No. 16/791,062 filed in the United States Patent and Trademark Office (USPTO) on 14 Feb. 2020; a continuation-in-part patent application claiming the benefit of pending International Patent Application No. PCT/US2020/030882 filed in the USPTO as International Receiving Office on 19 May 2020; and claims the benefit of U.S. Provisional Patent Application No. 63/029,376 filed in the USPTO on 22 May 2020, the specifications and drawings of which applications are hereby incorporated by reference thereto.

FIELD OF THE INVENTION

The present invention relates generally to cap formation for outfitting an upper lid assembly of a beverage can. More particularly, the present invention relates to a re-closeable cap as variously exemplified for integral assembly with or attachment to an upper can portion or lid assembly of a beverage can for covering a beverage-letting aperture formed in the upper can portion or lid assembly and/or for controlling beverage flow through or ready access to the beverage-letting aperture.

BRIEF DESCRIPTION OF THE PRIOR ART

The present invention was born from the recognition of a need in the prior art for a re-closeable cap that is easily outfittable upon a beverage can or easily pre-packaged atop beverage cans for consumer use. To address this need in the art, the author considered ways to develop a re-closeable cap that would be easy for a consumer to understand and to provide a cap that would require a subconsciously similar motor task memory type of function on par with that of opening a can with a can opener, for example. The author determined the importance for market adoption of a re-closeable cap may well stem from a flip-flop functioning mechanism to mimic the current teeter-totter type mechanism for opening cans of this type.

The presently described inventive concepts build upon the disclosures set forth in U.S. patent application Ser. No. 16/791,062 ('062 Application) and International Patent Application No. PCT/US2020/030882 ('882 Application) by providing a cap formation designed for integral assembly with or attachment to an upper can portion or lid assembly of a typical or state of the art beverage can ensemble, comprising a lower can body and an upper lid assembly attached to the lower can body after the top of the can body is trimmed. The lid assembly and the can body comprise flange structures which together are bent and seamed to secure the lid assembly after filing the can body with beverage or consumable material. The present invention is configured to outfit the lid assembly by the packager or manufacturer so as to provide a permanent, low-cost cap solution for typical lid assemblies.

The prior art thus perceives a need for a low cost, unibody, re-closeable can cap for outfitting an upper lid assembly portion of a beverage can and enabling a user to selectively cover the upper lid assembly portion for preventing contaminants from freely entering the otherwise open beverage can and further for controlling beverage flow from an open beverage can. Further, the prior art perceives a need for a re-closeable cap for outfitting a beverage can with a view toward improving or adding hygienic protections to beverage cans coming from manufacturers and/or beverage packaging companies throughout the distribution channels terminating at the user consumption point. The present invention attempts to address this perceived need by providing certain low cost, unibody, re-closeable cap formations for outfitting lid assemblies of beverage cans and providing removable barriers thereupon as the outfitted lid assemblies of beverage cans move through distribution channels.

SUMMARY OF THE INVENTION

To achieve the foregoing and other readily apparent objectives, the present invention may be said to essentially teach or disclose a lid cap or lid-cap combination when integrally formed with or fixedly attached to a lid assembly of a beverage can. In this regard, various lid cap embodiments described hereinafter are configured to outfit a lid assembly of a beverage can or a lid assembly that is attachable to a lower can body. The lid assembly usable in combination with the various lid caps essentially comprises a lid rim or lid rim portion, a lid capping plate, and a lid groove intermediate the lid rim and the lid capping plate.

In a first perspective, the various lid caps according to the present invention may be fairly said to essentially comprise a cap groove and a cap plate. The cap plate is centrally located relative to the cap groove, which cap groove is configured for attaching the lid cap to the lid assembly by mated engagement. The cap plate further preferably comprises a pivot structure. The pivot structure is pivotal for selectively providing a can-opening access aperture and selectively closing the can-opening access aperture. The can-opening access aperture enables a user to consume can contents by way of a can opening formed in the lid capping plate.

In certain lid cap embodiments, the cap groove is configured for mated insertion into the lid groove for attaching the lid cap to the lid assembly. A select lid cap may preferably also comprise a fastener-letting aperture. This lid cap may be attached to the lid capping plate via the can opener element and a fastener as extended through the fastener-letting aperture.

In certain iterations, an adhesive layer or adhesive portion may be provided intermediate the lid groove and the cap groove for fixedly attaching the lid cap to the lid assembly thereby forming a lid-cap combination. The adhesive may be of a heat-treatable type and may be set in combination with pressure applications. In this regard, it will be further recalled that the cap groove may be alternatively mechanically pressed into the lid groove via a tight structural engagement for fixedly attaching the lid cap to the lid assembly and forming a lid-cap combination.

In a second perspective, the present invention may be said to essentially provide a lid-cap combination for lidding-capping a lower can body. In this regard, the lower can body is lidded with a lid assembly by state-of-the-art methods, and the lid assembly as described is outfitted or capped with a lid cap as various exemplified. A select lid-cap combination may be said to essentially comprise a lid assembly and a lid cap. The lid assembly may be said to essentially comprise a lid rim portion, a lid capping plate, and a can opener element. The lid rim portion is attachable to a lower can body for lidding the lower can body.

The lid cap essentially comprises a cap plate centrally located relative to an outer cap periphery, which cap plate essentially comprises a fastener-letting aperture. The can opener element is attached to the lid capping plate via a fastener as extended through the fastener-letting aperture thereby sandwiching the cap plate intermediate the can opener element and the lid capping plate for firstly attaching the lid cap to the lid assembly. The lid assembly preferably comprises a lid groove intermediate the lid rim portion and the lid capping plate, and the lid cap may further preferably comprise a cap groove inwardly adjacent the outer cap periphery, which cap groove is configured for mated insertion into the lid groove for secondly attaching the lid cap to the lid assembly.

The cap plate may further preferably comprise a pivot structure for selectively providing a can-opening access aperture and selectively closing the can-opening access aperture. The can-opening access aperture enables a user to consume can contents by way of a can opening formed in the lid capping plate via the can opener element and the pivot structure. The pivot structure may preferably comprise a reconfigurable portion. The reconfigurable portion, being formed from or comprising a resilient or elastic material, is resiliently actuable intermediate at least two utilitarian configurations.

In a first aspect, the reconfigurable portion is resiliently actuable intermediate a first relaxed raised configuration and an actuated collapsed configuration. The first relaxed raised configuration enables a user to more easily manually pivot the pivot structure (and is relatively easy to manufacture by thermoforming processes) whereas the actuated collapsed configuration reduces volumetric space occupied by the reconfigurable portion (e.g. for packaging purposes). Configurations other than the first relaxed raised configuration are difficult, if not impossible, to provide by thermoforming processes given large gaps and laterally extending projections.

The cap groove may preferably comprise an outer groove terminal edge. The lid-cap combination is preferably nestable with a series of successive substantially identical lid-cap combinations such that the outer groove terminal edge(s) of lower lid-cap combinations space and support nested upper lid-cap combinations. The outer groove terminal edges of lower lid-cap combinations space nested upper lid-cap combinations for accommodating the actuated collapsed configurations of the reconfigurable portions.

In a second aspect, the internal resilience of the reconfigurable portion is operable to return the reconfigurable portion toward the first relaxed raised configuration when a collapsing force is removed therefrom. In this regard, the internal resilience of the reconfigurable portion is operable to return the reconfigurable portion to a second relaxed raised configuration when the collapsing force is removed therefrom, which second relaxed raised configuration is of a lesser raised height as compared to the first relaxed raised configuration. This feature provides packaging companies to modify packaging protocols, as discussed hereinabove. The reconfigurable portion is further preferably resiliently actuable intermediate an upwardly extending configuration and a downwardly extending configuration, which downwardly extending configuration is configured to selectively plug the can opening.

BRIEF DESCRIPTIONS OF THE DRAWINGS

Other features and objectives of the invention will become more evident from a consideration of the following brief descriptions of patent drawings.

Figure 25:
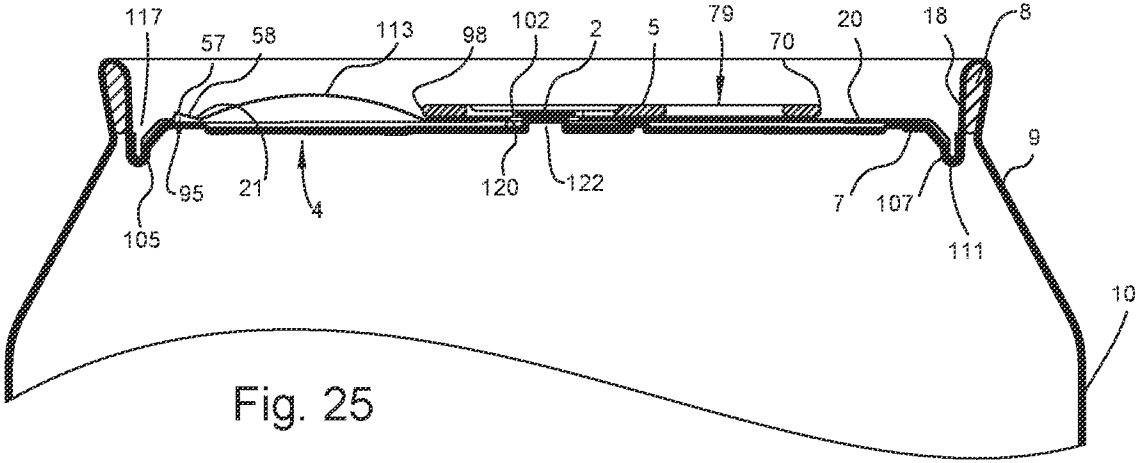
FIG. 25 is a first sequential diagrammatic longitudinal cross-sectional depiction of the third alternative lid-cap ensemble attached to a lower can body with the can lid in an unopened configuration and the reconfigurable portion of a pivot structure of the third alternative lid cap in a first relaxed raised configuration.
Figure 25A:
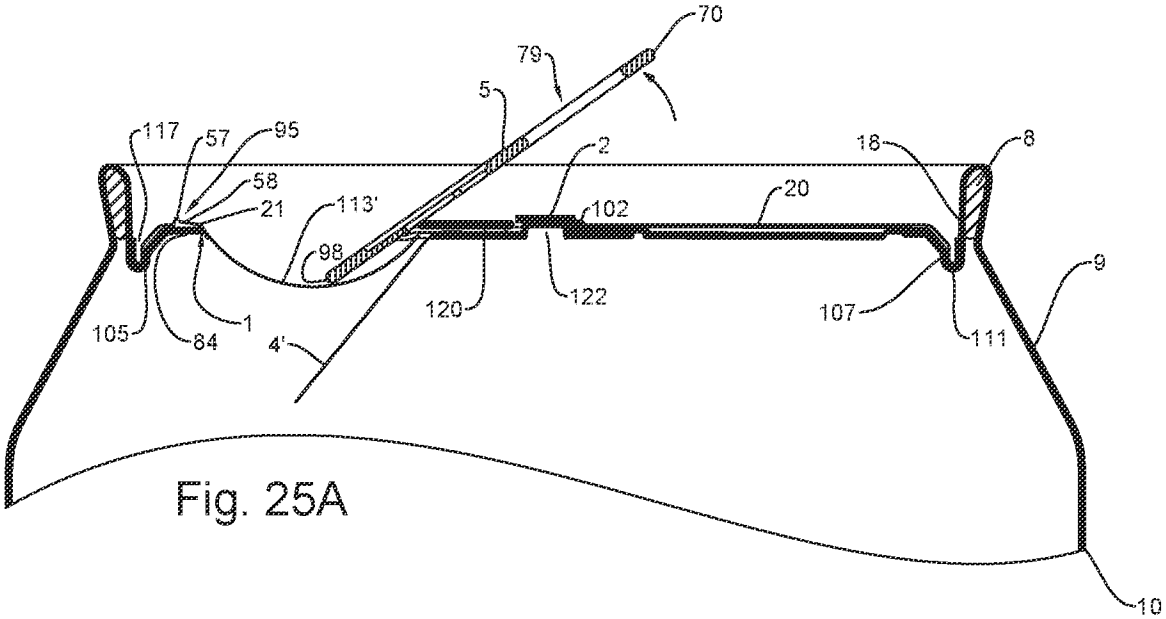
FIG. 25A is a second sequential diagrammatic longitudinal cross-sectional depiction of the third alternative lid-cap ensemble attached to a lower can body with the can lid being opened via the can opener element and the reconfigurable portion of the pivot structure of the third alternative lid cap being depressed into a can-opening plug configuration.
Figure 25B:
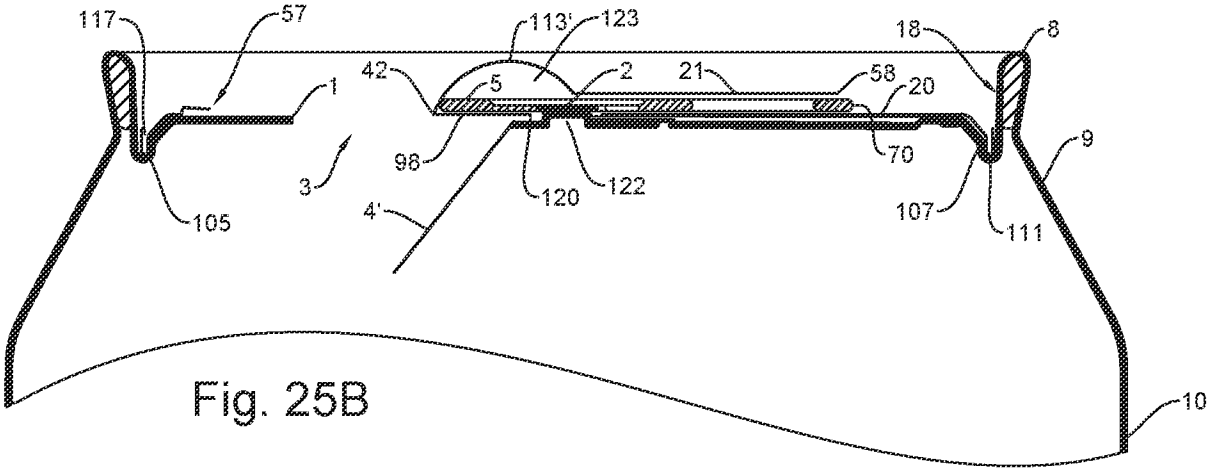
FIG. 25B is a third sequential diagrammatic longitudinal cross-sectional depiction of the third alternative lid-cap ensemble attached to a lower can body with the can lid in an opened configuration and the reconfigurable portion of the pivot structure of the third alternative lid cap in a depressed can-opening plug feature configuration, but pivoted to a can opening access configuration.
Figure 25C:
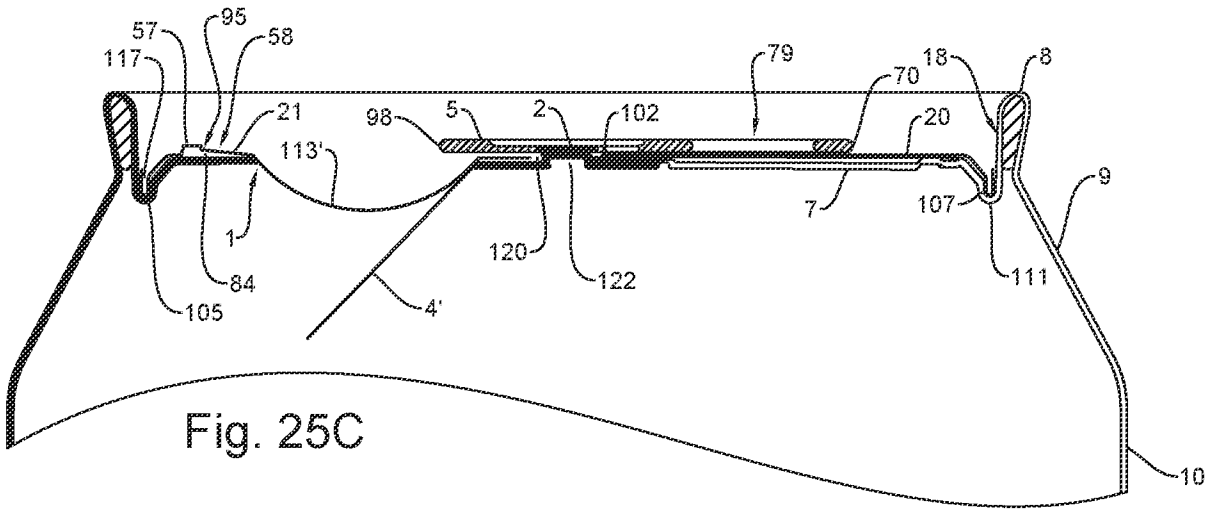

FIG. 25C is a fourth sequential diagrammatic longitudinal cross-sectional depiction of the third alternative lid-cap ensemble attached to a lower can body with the can lid opened with the can opener element pivoted into parallel relation with the lid capping plate and the reconfigurable portion of the pivot structure of the third alternative lid cap re-pivoted into the can-opening plug configuration.

Figure 26:
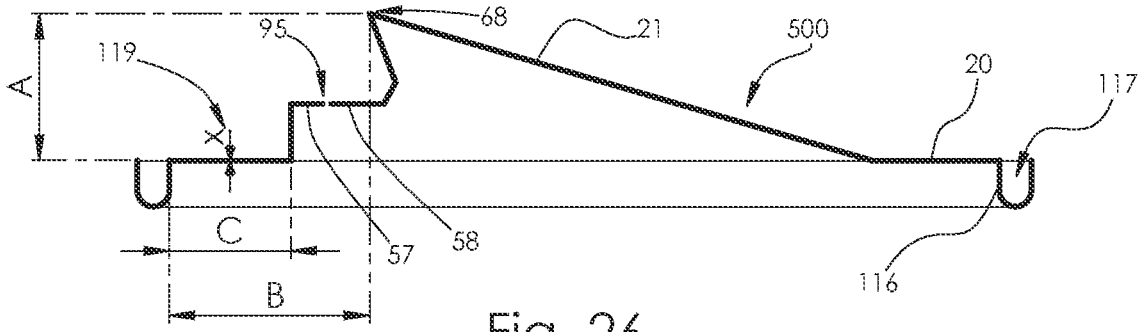

FIG. 26 is a first sequential diagrammatic longitudinal cross-sectional type depiction of the third alternative lid cap according to the present invention with the reconfigurable portion of the pivot structure being shown in a first relaxed raised configuration.

Figure 27:
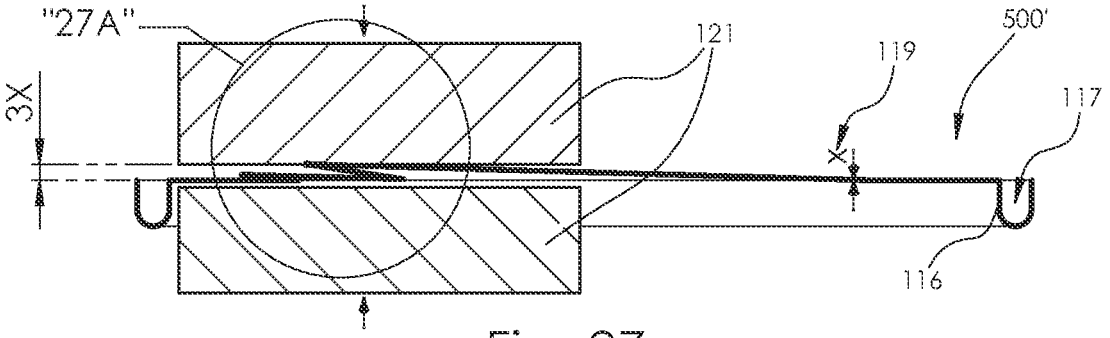

FIG. 27 is a second sequential diagrammatic longitudinal cross-sectional type depiction of the third alternative lid cap according to the present invention with the reconfigurable portion of the pivot structure being shown in an actuated collapsed configuration.

Figure 27A:
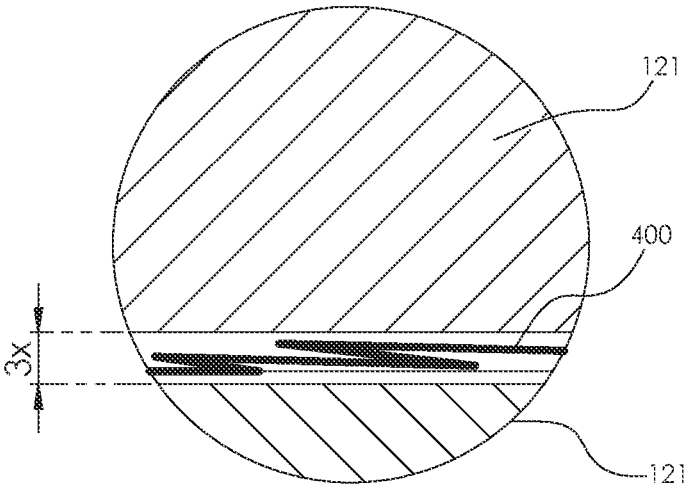

FIG. 27A is an enlarged sectional view as enlarged and sectioned from FIG. 27 to show in greater detail the reconfigurable portion of the pivot structure in the actuated collapsed configuration between two press plates.

Figure 28:
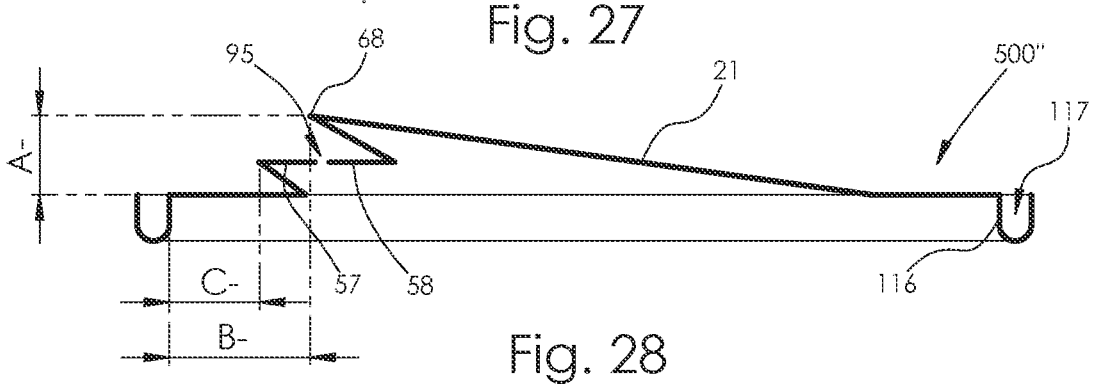

FIG. 28 is a third sequential diagrammatic longitudinal cross-sectional type depiction of the third alternative lid cap according to the present invention with the reconfigurable portion of the pivot structure being shown in a second relaxed raised configuration.

DETAILED DESCRIPTION OF THE PREFERRED EMBODIMENTS

Referring now to the drawings with more specificity, the following specifications generally describe certain re-closeable lid caps as variously exemplified for outfitting and capping lid assemblies of beverage cans, which beverage cans have become relatively standard in the industry for serving beverages to consumers. A beverage can essentially comprises a lower can body and a lid assembly. A lower can body 10 separately attachable to a lid assembly 110 and usable in combination with the re-closeable lid caps according to the present invention is generally depicted and referenced throughout the illustrative matter submitted in support of these specifications.

Whereas the detailed descriptions of U.S. patent application Ser. No. 16/791,062 ('062 Application) and International Patent Application No. PCT/US2020/030882 ('882

Figure 9:
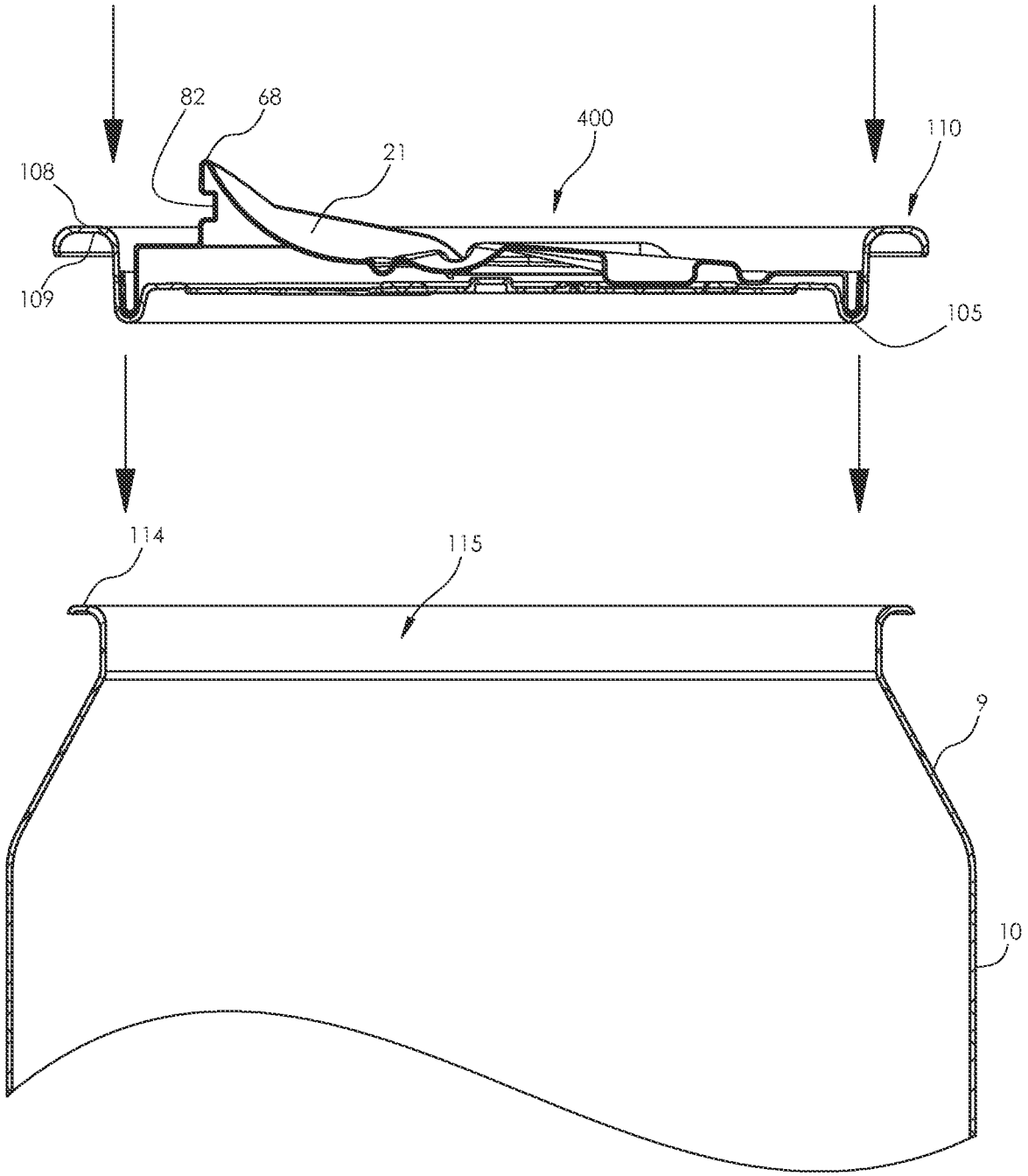
FIG. 9 is a longitudinal cross-sectional exploded view of the first alternative lid cap according to the present invention in assembled relation with a lid assembly (a first cap-lid ensemble) being directed toward a lower can body for finally attaching the first cap-lid ensemble to the lower can body.
Figure 10B:
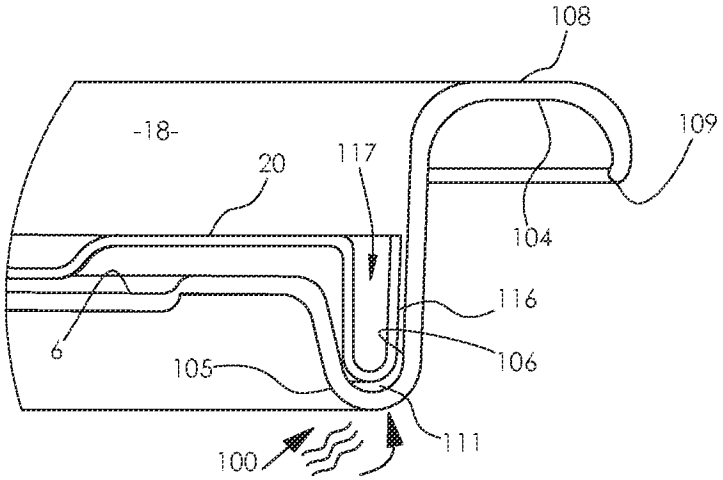
FIG. 10B is a second enlarged fragmentary sectional view as enlarged and sectioned from FIG. 10 to show in still greater detail the structural relationship between the first alternative lid cap relative to the lid assembly.
Figure 10A:
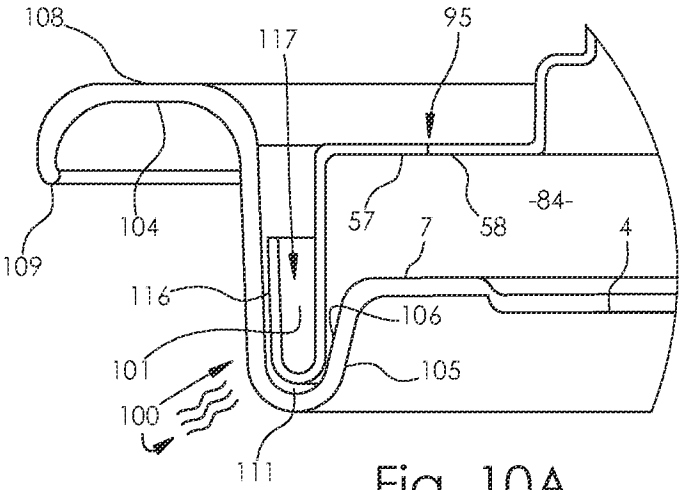
FIG. 10A is a first enlarged fragmentary sectional view as enlarged and sectioned from FIG. 10 to show in still greater detail the structural relationship between the first alternative lid cap relative to the lid assembly.
Figure 10:
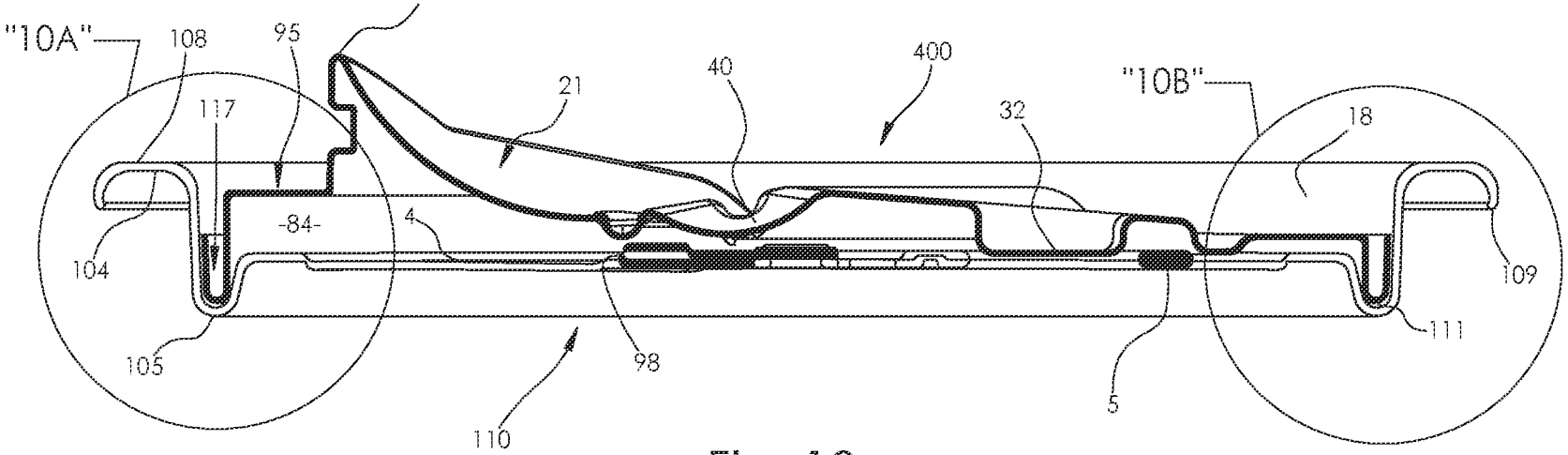
FIG. 10 is a first enlarged longitudinal cross-sectional view of the first cap-lid ensemble to show in greater detail the structural relationship between the first alternative lid cap relative to the lid assembly.

Application), to which this application claims a benefit, discuss the beverage can as a singular article of manufacture, these specifications shift somewhat the focus toward the lid assembly 110 that is separately attachable to a lower can body 10. The illustrative matter submitted in support of these descriptions, for example, show a lower can body 10 detached from the lid assembly 110. The lower can body 10 as detached from the lid assembly 110 more clearly shows a frustoconical neck portion 9, an upper can body flange 114, and a can neck opening 115 as depicted in FIG. 9.

The lid assembly 110 attachable to the lower can body 10 may be said to preferably comprise a lid flange or rim portion as at 108, a lid capping plate as at 7, and a circumferential lid groove 107 intermediate the lid flange 108 and the lid capping plate 7. The lid flange 108 and the can flange 114 are together crimped to finally attach/seam the lid assembly 110 to the lower can body 10 to form a can rim 8, the upper/outer portion of which is the lid flange otherwise described as a lid/can rim portion in radial outer adjacency to the lid groove 107. The lid assembly 110 further comprises a can opener element as at 5. The can opener element 5 comprises an axis or center of rotation 2 extending through a rivet fastener 122 and a cooperating can opener loop flange 102 through which the rivet 122 extends via loop flange aperture 103 for attaching the can opener element 5 to the lid capping plate 7 enabling rotation of the can opener element 5 relative to the lid capping plate 7.

Figure 4:
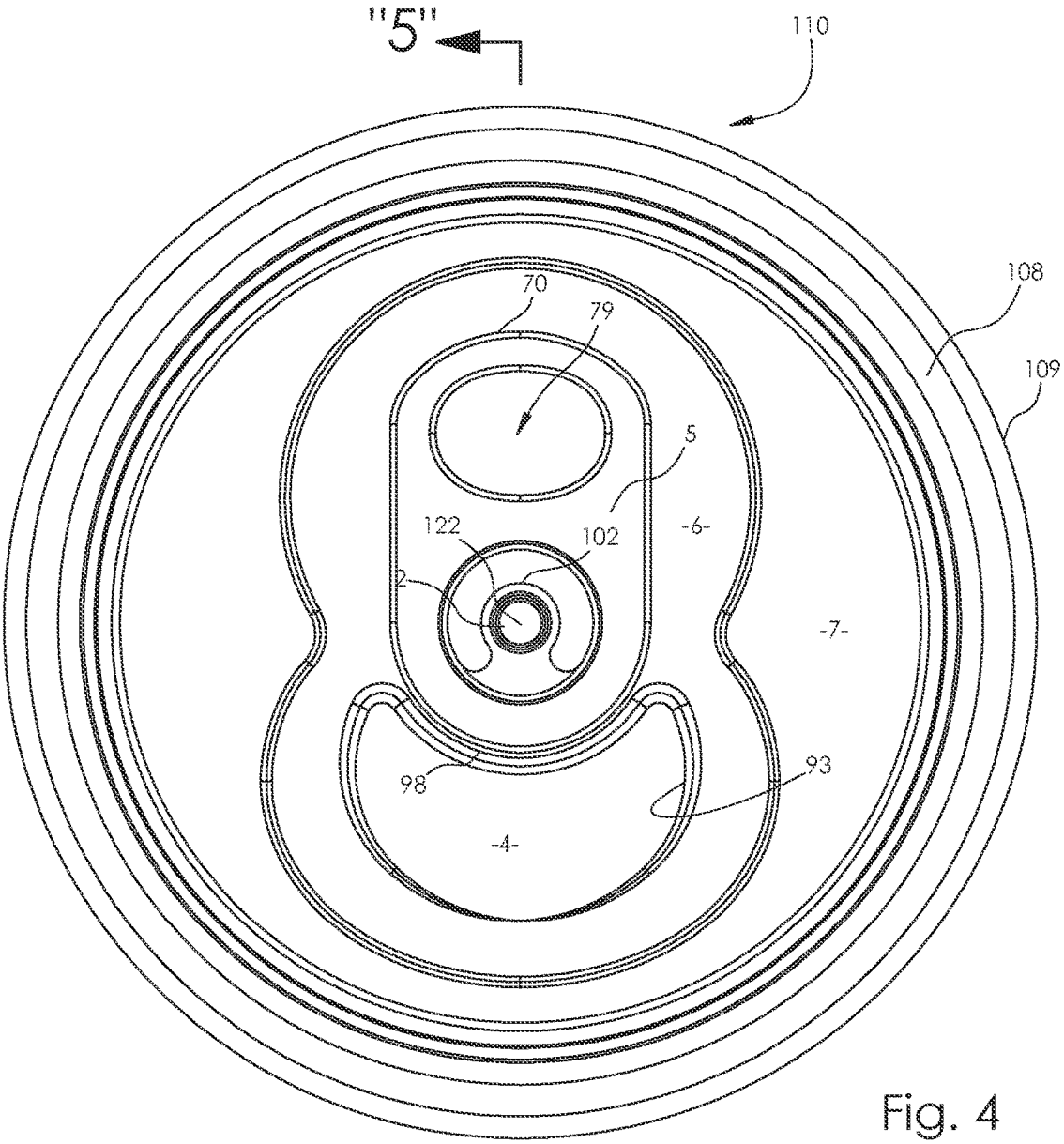
FIG. 4 is a top plan view of an upper lid assembly usable in combination with the lid cap(s) according to the present invention and attachable to a lower can body showing lid assembly features.
Figure 5:
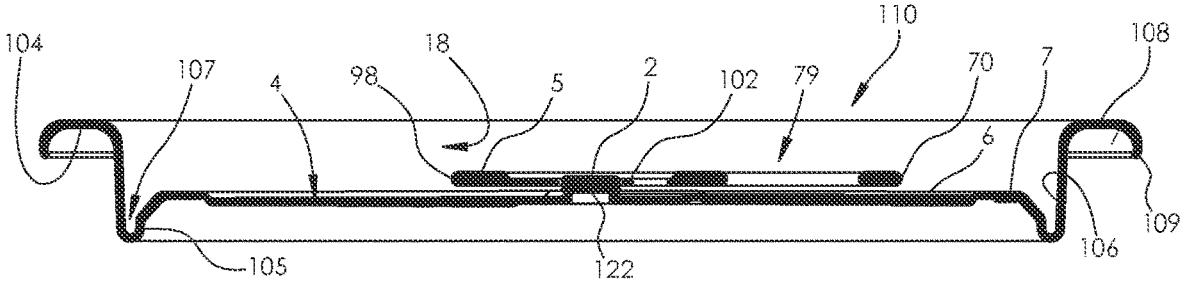
FIG. 5 is a longitudinal cross-sectional view as sectioned from FIG. 4 to further depict lid assembly features of the upper lid assembly usable in combination with the can lid cap(s) according to the present invention.

The lid capping plate 7 may preferably comprise an indentation as at 6 that surrounds the can opener element 5 and the aperture-forming plate 4. The can opener element 5 is pivotal such that the opener tip 98 engages the aperture-forming plate 4. The force directed into the aperture-forming plate 4 detaches the aperture-forming plate 4 from a score line 93 forming a can access aperture 3 with can opening edge 1. Comparatively referencing FIGS. 4 and 5, the reader will there note further lid assembly 110 features, including an opener edge 70 opposite the opener tip 98 and a can opener gap 79 formed in the can opener element 5. The lid flange 108 comprises an outer flange edge 109 and a flange under surface 104 that engages the can flange 114. The circumferential lid groove 107 comprises a groove outer surface 105 and a groove inner surface 106 that extends upwardly as a lid/can rim wall 18.

The lid caps hereinafter discussed are usable in combination with the lid assembly 110 and as such are made usable in combination with the lower can body 10 once the lid assembly 110 is sealed to the lower can body 10. There are several lid cap embodiments hereinafter discussed and identified as a first alternative lid cap as at 400, a second alternative lid cap as at 401, a third alternative lid cap as at 200, and a fourth alternative lid cap as at 500. Referencing FIG. 1, the reader will there consider the first alternative lid cap 400 shown in exploded relation relative to the lid assembly 110, which lid assembly 110 is shown in exploded relation relative to the lower can body 10.

Figure 1:
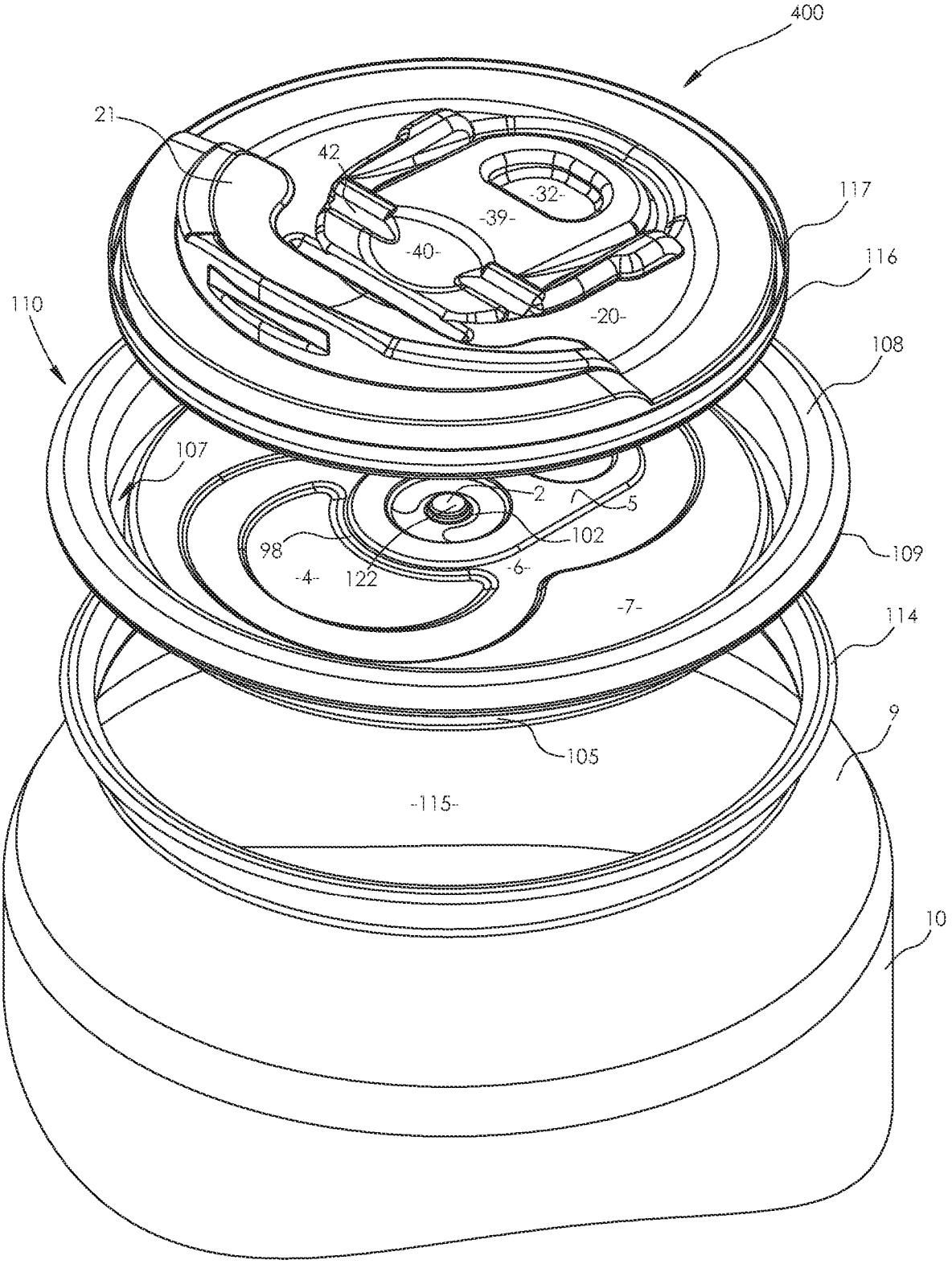
FIG. 1 is an exploded top perspective view of three components depicting from bottom to top a fragmentary lower can body, a lid assembly, and a first alternative lid cap according to the present invention.
Figure 3:
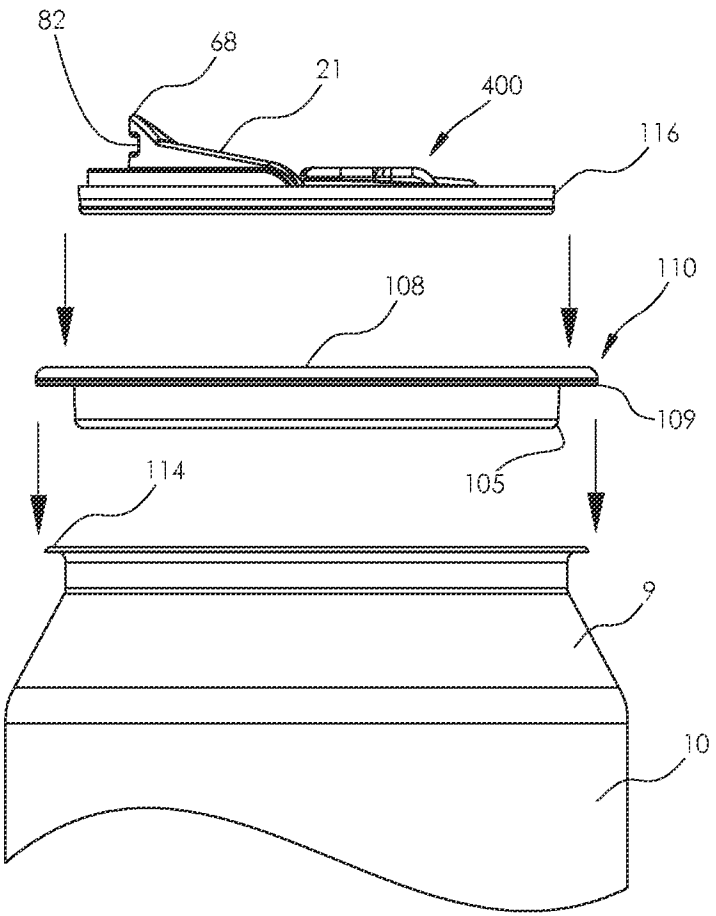
FIG. 3 is an exploded lateral elevational view of three components depicting from bottom to top a fragmentary lower can body, a lid assembly, and the first alternative lid cap according to the present invention with arrows depicting directional movement of component assembly.
Figure 2:
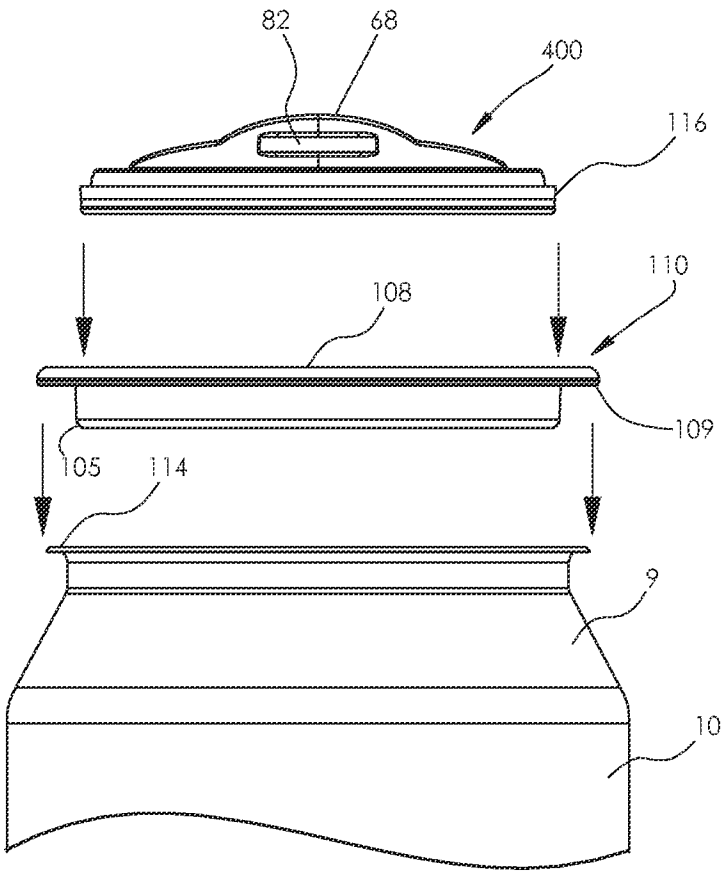
FIG. 2 is an exploded anterior view of three components depicting from bottom to top a fragmentary lower can body, a lid assembly, and the first alternative lid cap according to the present invention with arrows depicting directional movement of component assembly.

The first alternative lid cap 400 as illustrated in FIG. 1 highlights certain features including a first pivot mechanism or pivot structure as at 21; a central depression as at 40; a second pivot mechanism or pivot structure and opener cover as at 39; a locking depression 32; a cap plate portion 20; and a circumferential cap groove 117 with an outer cap groove surface 116. Comparatively referencing FIGS. 2 and 3, the reader will there further consider an upper portion or tip 68 of the first pivot structure 21 with a groove 82 formed therein for enabling the user to more effectively and manually pivot the first pivot structure 21 about a pivot axis exemplified by a living hinge as at 42. The arrows in FIGS. 2 and 3 depict directional movement as the first alternative lid cap 400 is assembled to the lid assembly 110 and as the cap-outfitted lid assembly 110 is assembled to the lower can body 10.

Central to the practice of the first alternative lid cap 400 is the circumferential cap groove 117, which cap groove 117 is configured to mate with the circumferential lid groove 107. The outer cap groove surface 116 frictionally engages the inner lid groove surface 106 and thus the cap groove 117 mates with the lid groove 107. In a preferred practice, an adhesive layer or portion 111 may be provided intermediate the outer cap groove surface 116 and the inner lid groove surface 106 for ensuring a permanent adhesion and fitted engagement between the first alternative lid cap 400 and the lid assembly 110.

Figure 11:
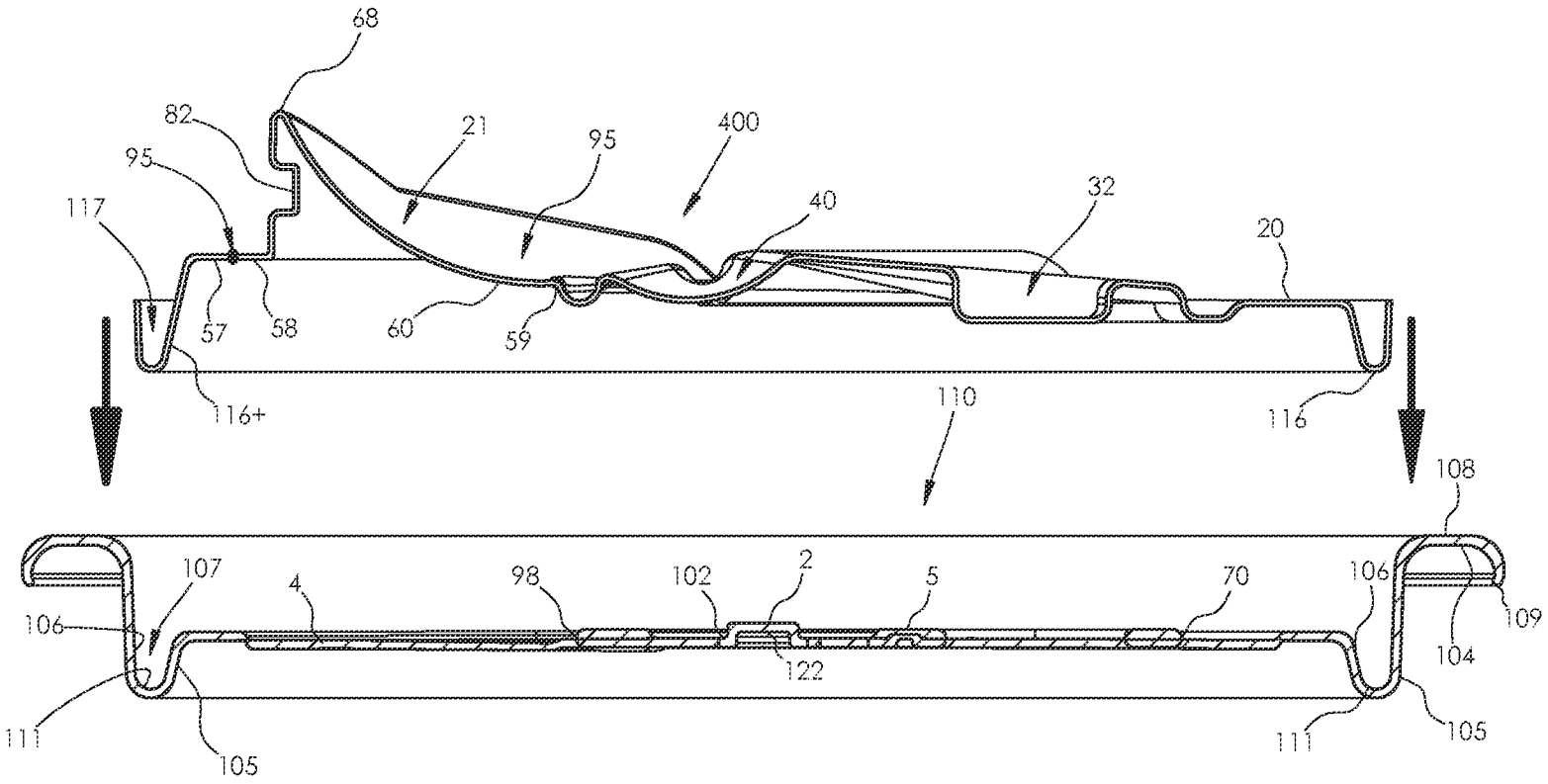
FIG. 11 is a longitudinal cross-sectional exploded view of the first alternative lid cap according to the present invention being directed toward a lid assembly for permanent attachment thereto for forming the first alternative cap-lid ensemble according to the present invention.

Referencing FIGS. 10-12B, for example, the reader will there consider the lid cap 400 coupled with or mated to the lid assembly 110 using adhesive 111 applied in the deep end of lid groove 107. The preferred adhesive is a heat-sensitive, food grade adhesive and may preferably be pre-applied within the deep end of the lid groove 107. Heat as at 100 may then be applied against the outer groove surface 105 and pressure may be preferably applied from the inner surface 101 of the cap groove 117 to ensure proper adhesive attachment between the cap groove 117 and the lid groove 107. FIG. 11 further highlights certain features of the lid cap 400, including an edge 57 of a cap opening and an edge 58 of the first pivot structure 21. Intermediate the edge 57 of the cap opening and an edge 58 of the first pivot structure 21 is a perforation, score or cut line 95. An edge 59 of a lid cap flange also opposes an inner edge 60 of the first pivot structure 21.

Figure 12:
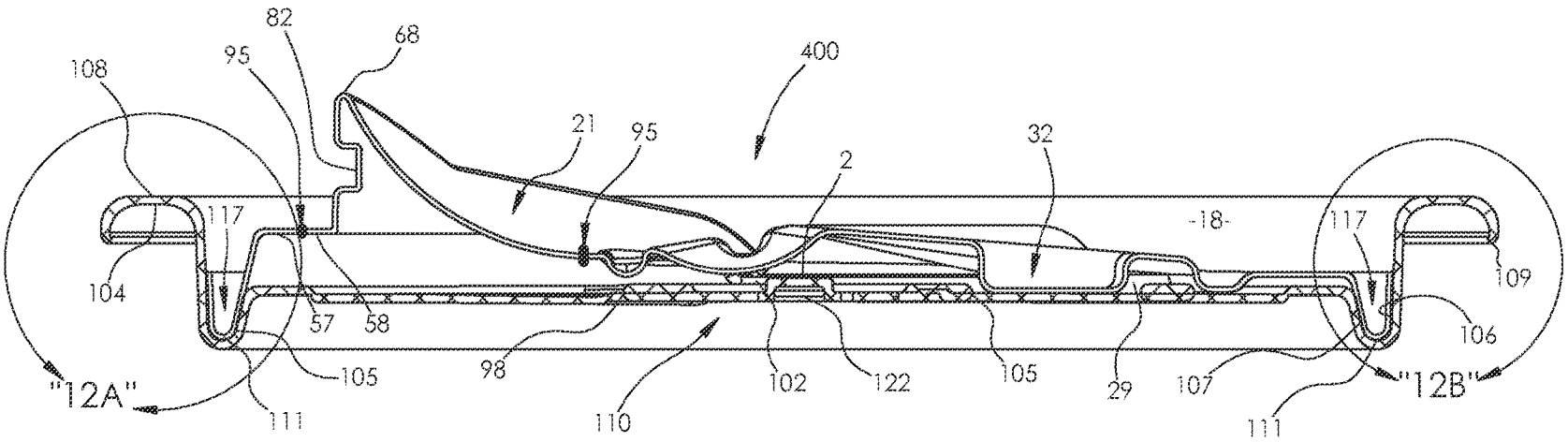
FIG. 12 is a second enlarged longitudinal cross-sectional view of the first cap-lid ensemble to show in greater detail adhesive attachment between the first alternative lid cap and the lid assembly.
Figure 12B:
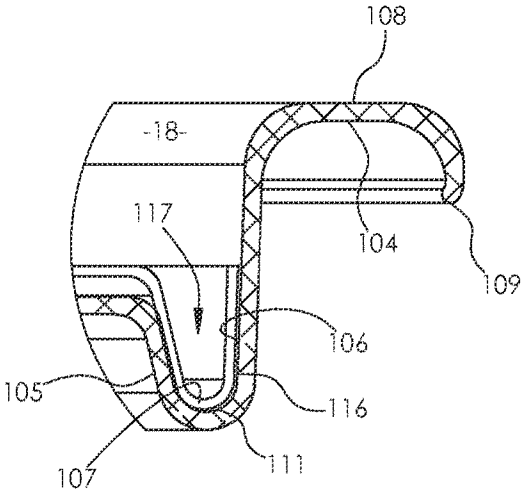
FIG. 12B is a second enlarged fragmentary sectional view as enlarged and sectioned from FIG. 12 to show in still greater detail the adhesive attachment between the first alternative lid cap and the lid assembly.
Figure 12A:
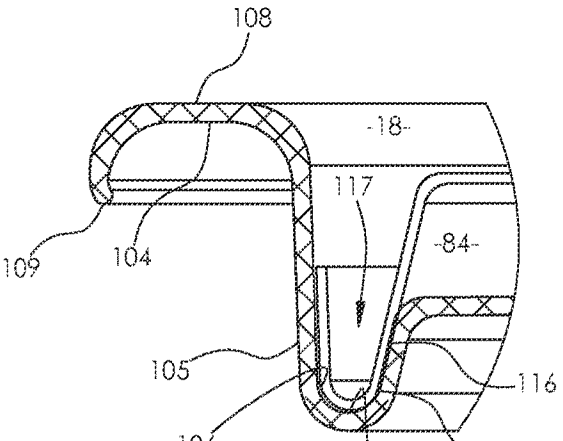
FIG. 12A is a first enlarged fragmentary sectional view as enlarged and sectioned from FIG. 12 to show in still greater detail the adhesive attachment between the first alternative lid cap and the lid assembly.
Figure 13:
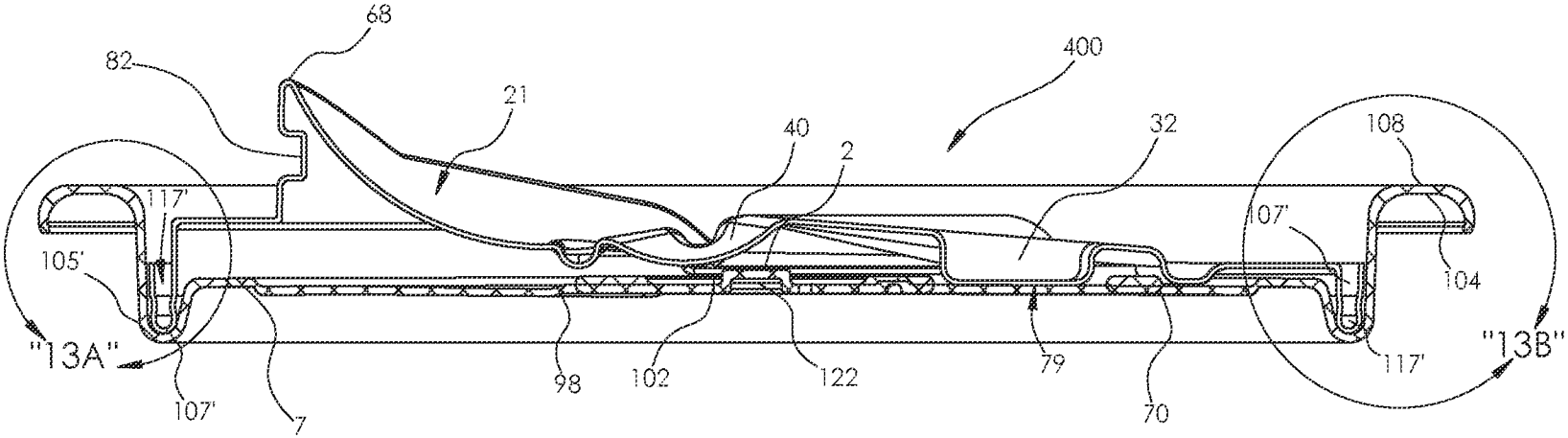
FIG. 13 is a third enlarged longitudinal cross-sectional view of the first cap-lid ensemble to depict in greater detail mechanically pressed attachment between the first alternative lid cap and the lid assembly.
Figure 13B:
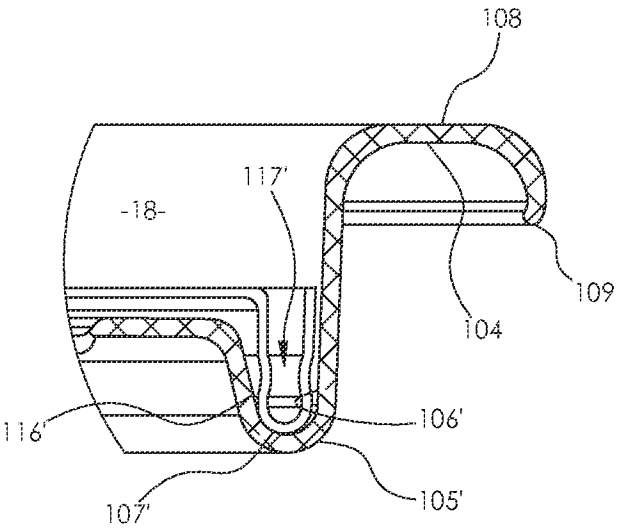
FIG. 13B is a second enlarged fragmentary sectional view as enlarged and sectioned from FIG. 13 to depict in still greater detail the mechanically pressed attachment between the first alternative lid cap and the lid assembly.
Figure 13A:
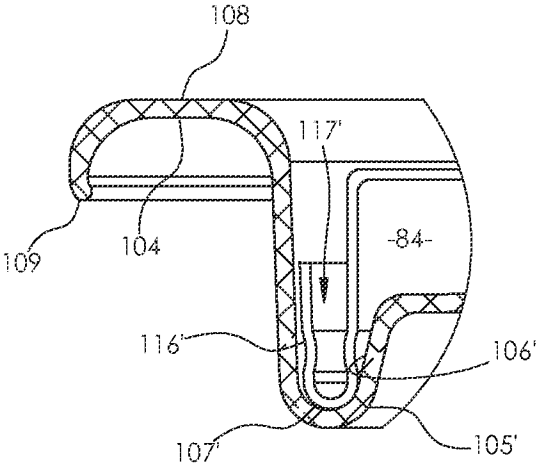
FIG. 13A is a first enlarged fragmentary sectional view as enlarged and sectioned from FIG. 13 to depict in still greater detail the mechanically pressed attachment between the first alternative lid cap and the lid assembly.

Comparatively referencing FIGS. 12-12B versus FIGS. 13-13B, the reader will there further consider an alternative method of ensuring permanent attachment of the lid cap 400 to the lid assembly 110. Whereas FIGS. 12-12B depict an adhesive means of attaching the lid cap 400 to the lid assembly 110 via the cap groove 117 and the lid groove 107, FIGS. 13-13B depict a lid assembly 110 being outfitted with a lid cap 400 by way of mechanical press whereby the cap groove 117 is press fit into the lid groove 107 such that the inner groove surfacing 106' squeezes the outer groove surfacing 116' and the resulting pinched structural relationship operates to retain the lid cap 400 in attachment to the lid assembly 110.

Figure 14:
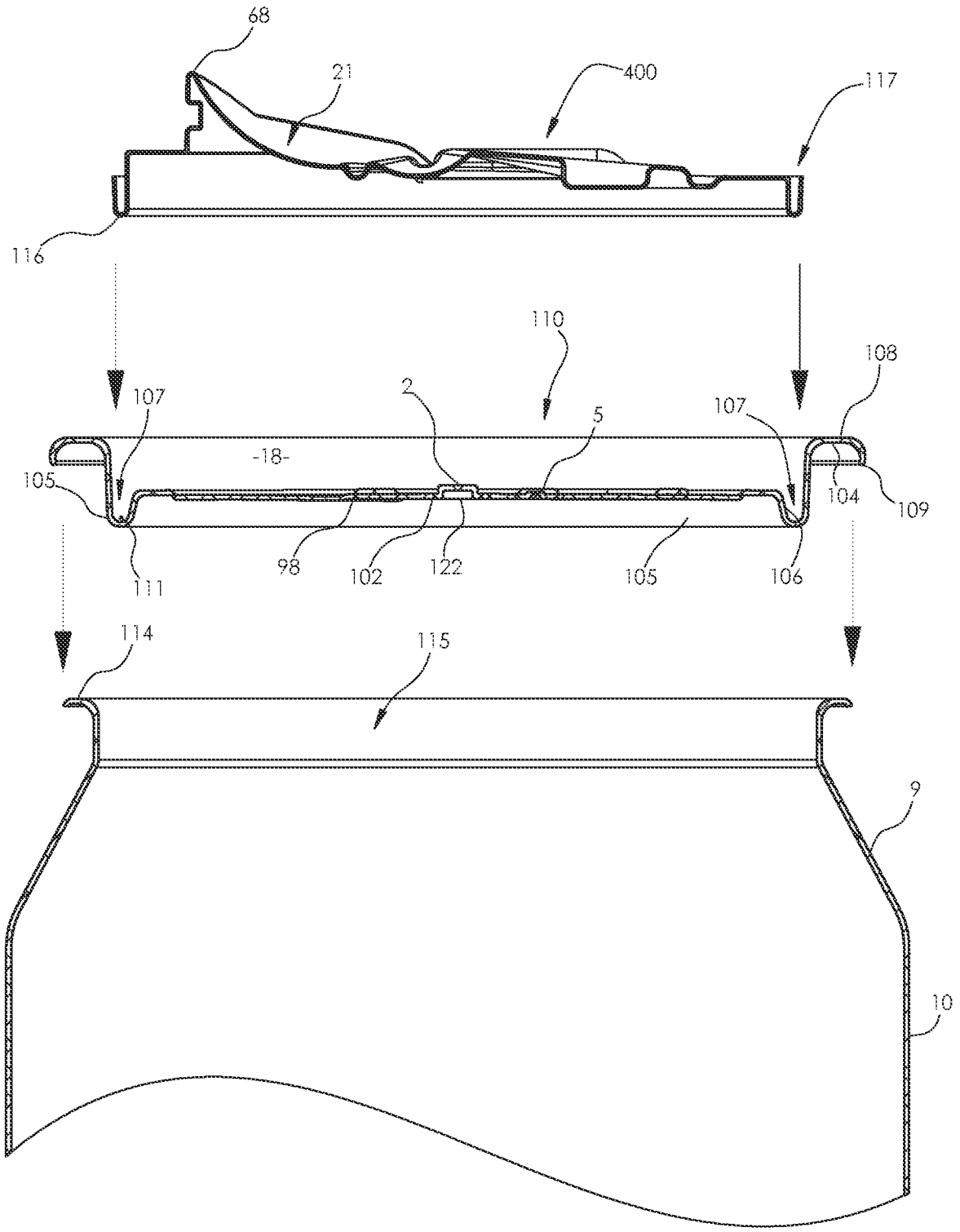
FIG. 14 is an enlarged exploded lateral view of three components depicting from bottom to top a fragmentary lower can body, a lid assembly, and the first alternative lid cap according to the present invention with arrows depicting directional movement of component assembly.

FIG. 14, however, again depicts the preferred means of attachment including the step of applying an adhesive 111 to the deep end of the lid groove 107. The lid cap 400 is preferably adhesively attached to the lid assembly 110 via surfacing 106 and 116 and the lid assembly 110 is attached to the lower can body 10 via state-of-the-art methods.

Figure 6:
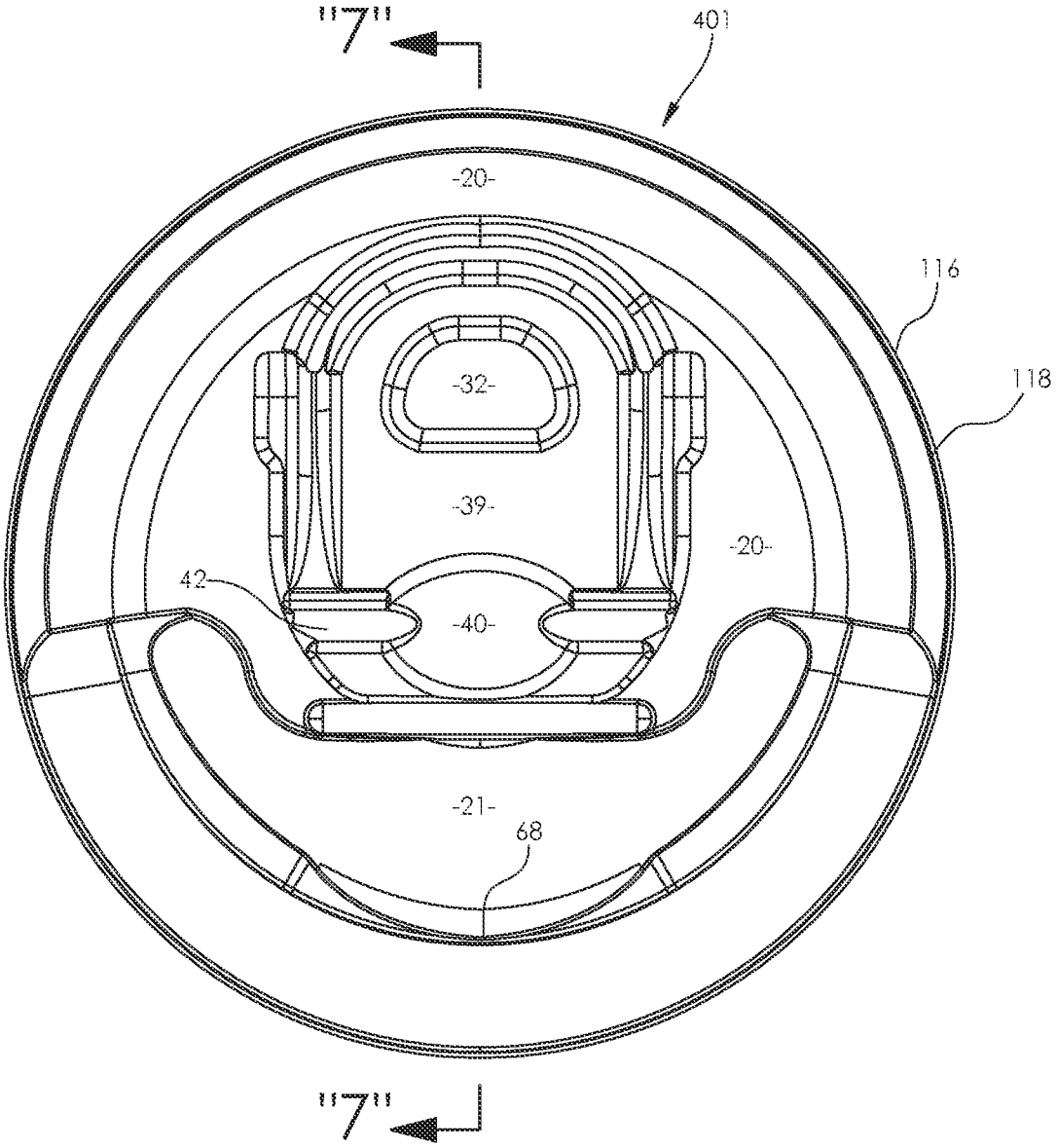
FIG. 6 is a top plan view of a second alternative lid cap according to the present invention.
Figure 7:
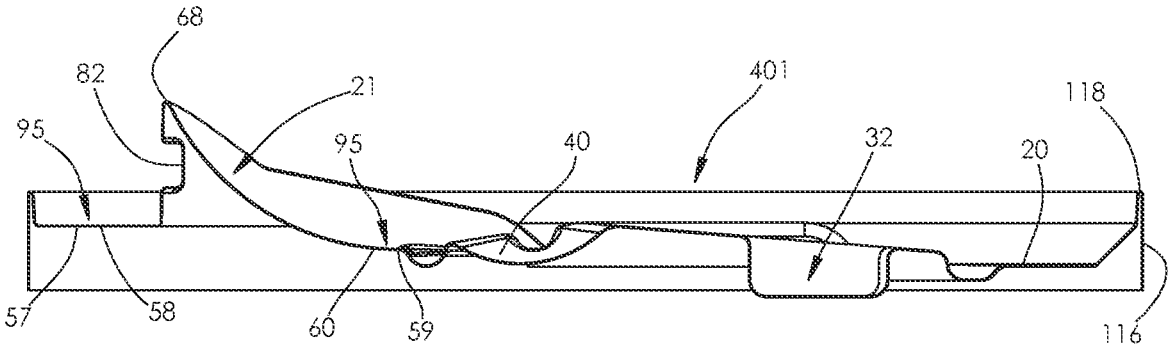
FIG. 7 is a longitudinal cross-sectional view as sectioned from FIG. 6 to further depict features of the second alternative lid cap according to the present invention.
Figure 8:
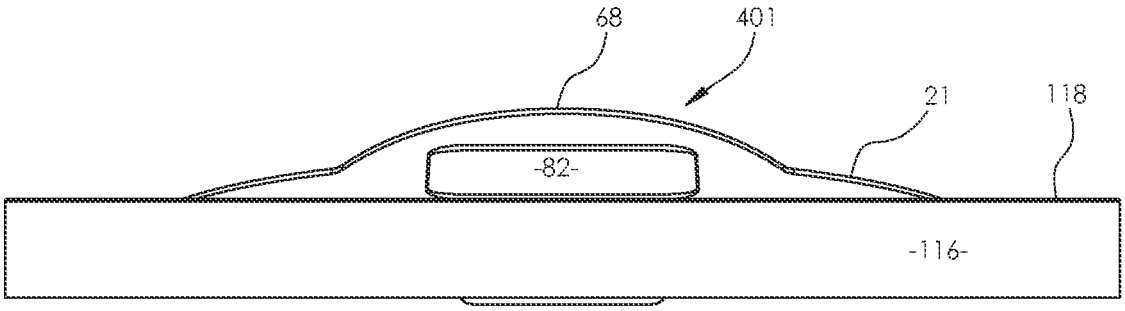
FIG. 8 is an anterior elevation edge view of the second alternative lid cap according to the present invention.

The second alternative lid cap 401 according to the present invention is generally depicted and referenced in FIGS. 6-8. The second alternative lid cap 401 differs from the first alternative lid cap 400 by inverting the cap groove 118 to oppose the lid groove 107 such that the outer groove surface 116 of cap groove 118 still frictionally engages the inner groove surface 106 of the lid groove 107, but the cap groove 118 directionally opposes the lid groove 107. Adhesive means for attaching the outer groove surface 116 of the cap groove 118 to the inner groove surface 106 of the lid groove 107 are contemplated. Heat may then be applied against the outer groove surface 105 and pressure may be preferably applied from the inner surface 101 of the cap groove 118 to ensure proper adhesive attachment between the cap groove 118 and the inner groove surface 106 of lid groove 107.

Figure 20:
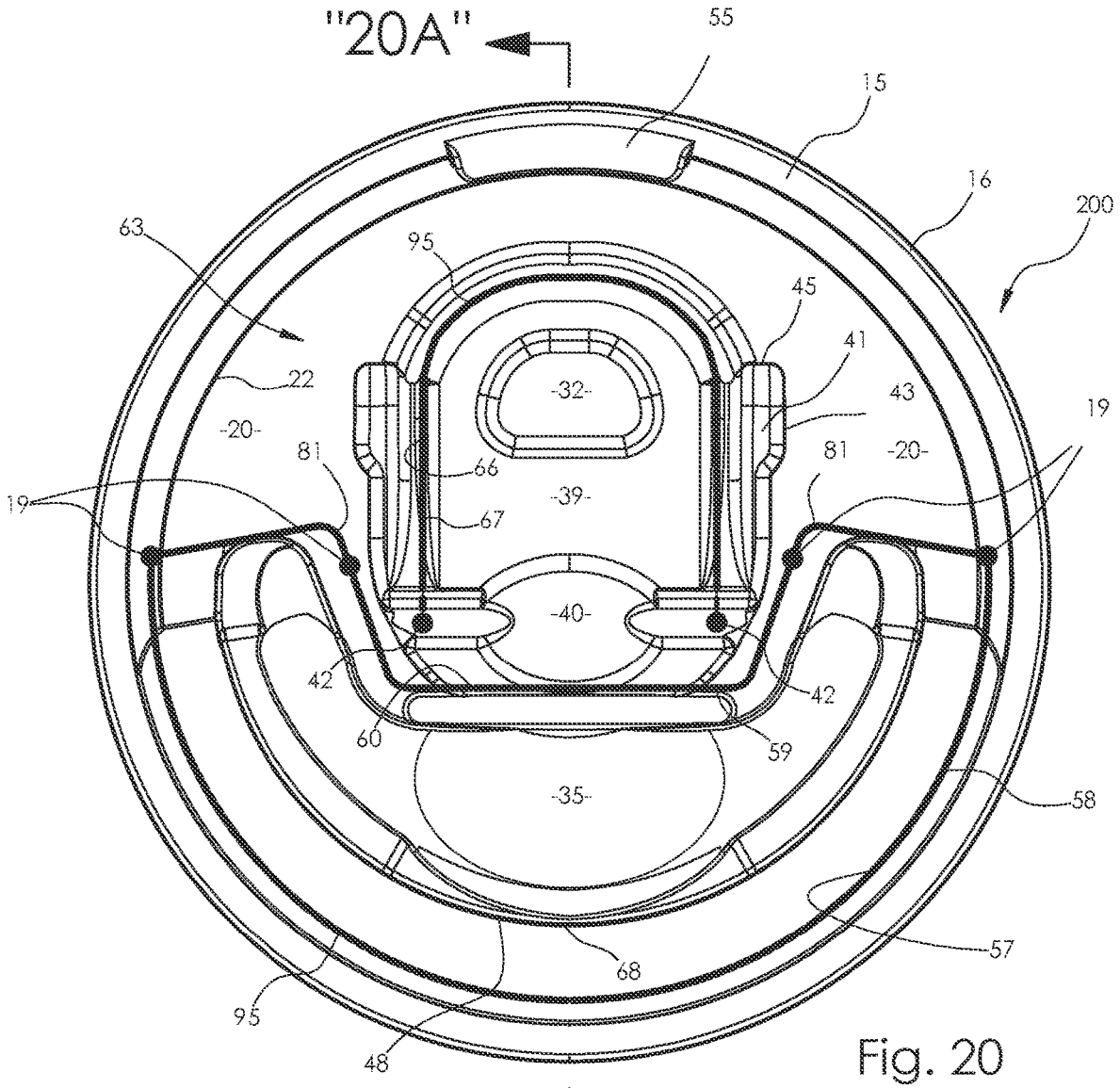
FIG. 20 is a top plan view of a fourth alternative lid cap according to the present invention similar to FIG. 38 of the '882 Application with modifications to highlight a new plug depression feature.
Figure 20A:
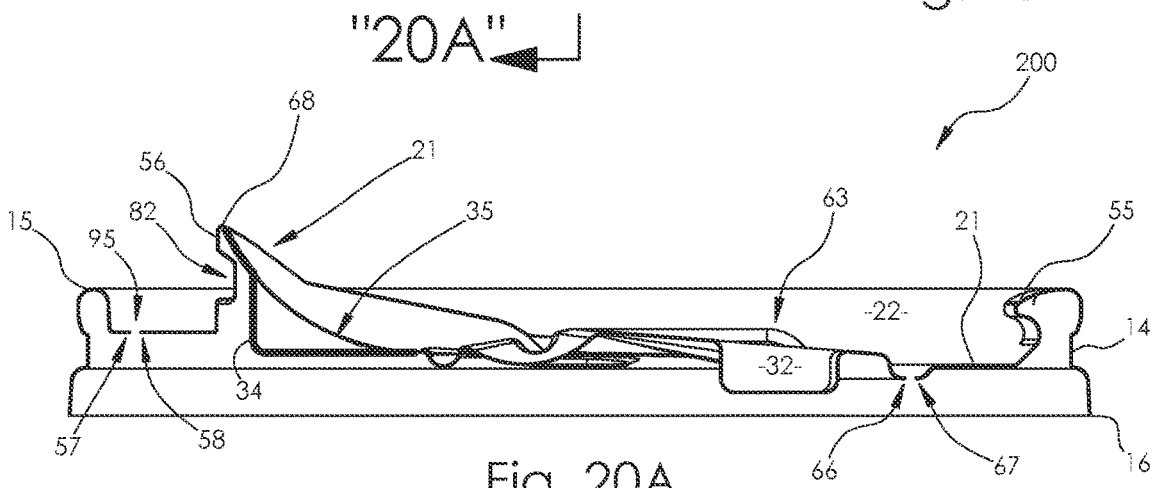
FIG. 20A is a longitudinal cross-sectional view as sectioned from FIG. 20 to alternatively show features of the fourth alternative lid cap according to the present invention.
Figure 21:
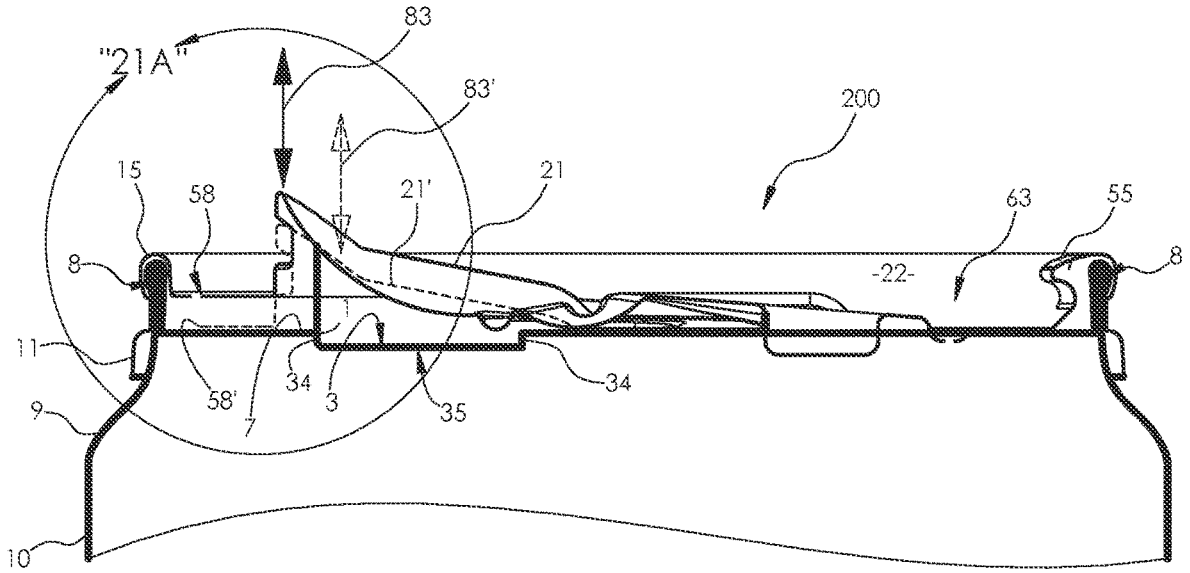
FIG. 21 is a longitudinal cross-sectional view of a fourth cap-lid ensemble attached to a fragmentary lower can body to highlight a plug depression feature closing the can opening otherwise formed in the fourth alternative cap-lid ensemble according to the present invention.
Figure 21B:
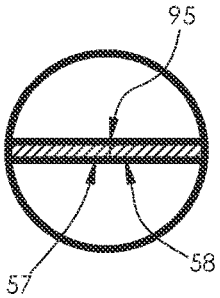
FIG. 21B is an enlarged, fragmentary sectional depiction as enlarged and sectioned from FIG. 21A to show in greater clarity or detail an edge-to-edge scored separation point along the dotted line detail of the cap swinging structure of the fourth alternative cap-lid ensemble.

The third alternative lid cap 200 according to the present invention is generally depicted and referenced in FIGS. 20-21B. The reader may wish to further reference FIGS. 38-38D of the '882 Application as the drawing content presented by FIGS. 20-21B of this application and FIGS. 38-38D of the '882 Application are substantially similar. The third alternative lid cap 200 attaches to the lid assembly 110 by a cap rim 15 with rim-receiving groove as at 14, which receives the lid rim portion 108. The content illustrated in FIGS. 20-21B attempts to draw the reader's attention to a plug depression feature of the first pivot structure 21 as new to these specifications. The plug depression feature is referenced at 35 and the plug depression side walls are referenced at 34. Referencing FIG. 20, the reader will there see that the plug depression 35 is dimensioned to roughly equal the dimensions of a can access aperture 3 formed in a lid assembly 110 when the can opener element 5 is operated to open the lid assembly 110 and expose can contents.

Figure 21A:
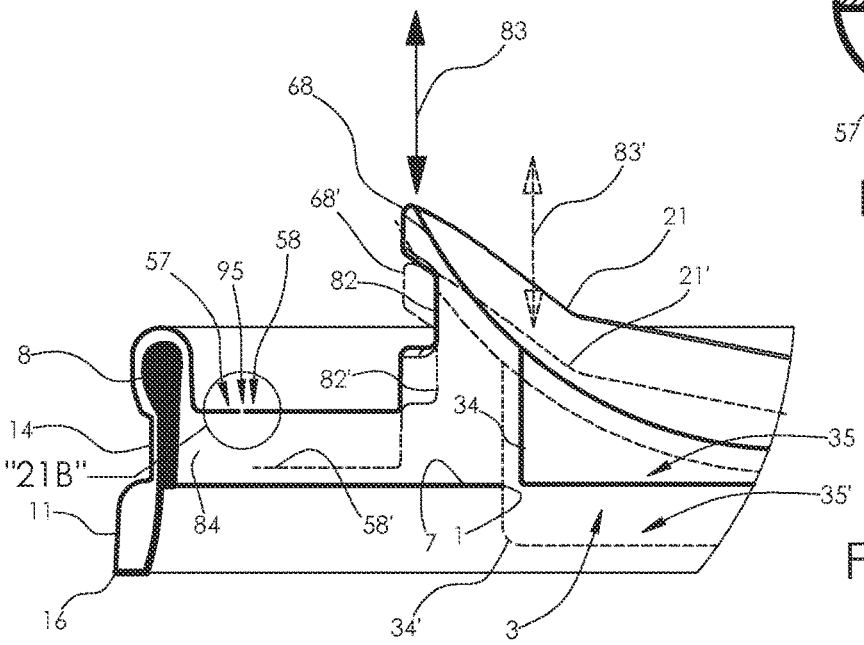
FIG. 21A is an enlarged fragmentary sectional view as enlarged and sectioned from FIG. 21 to depict in greater detail the plug depression feature for closing the can opening otherwise formed in the fourth alternative cap-lid ensemble according to the present invention.
Figure 22:
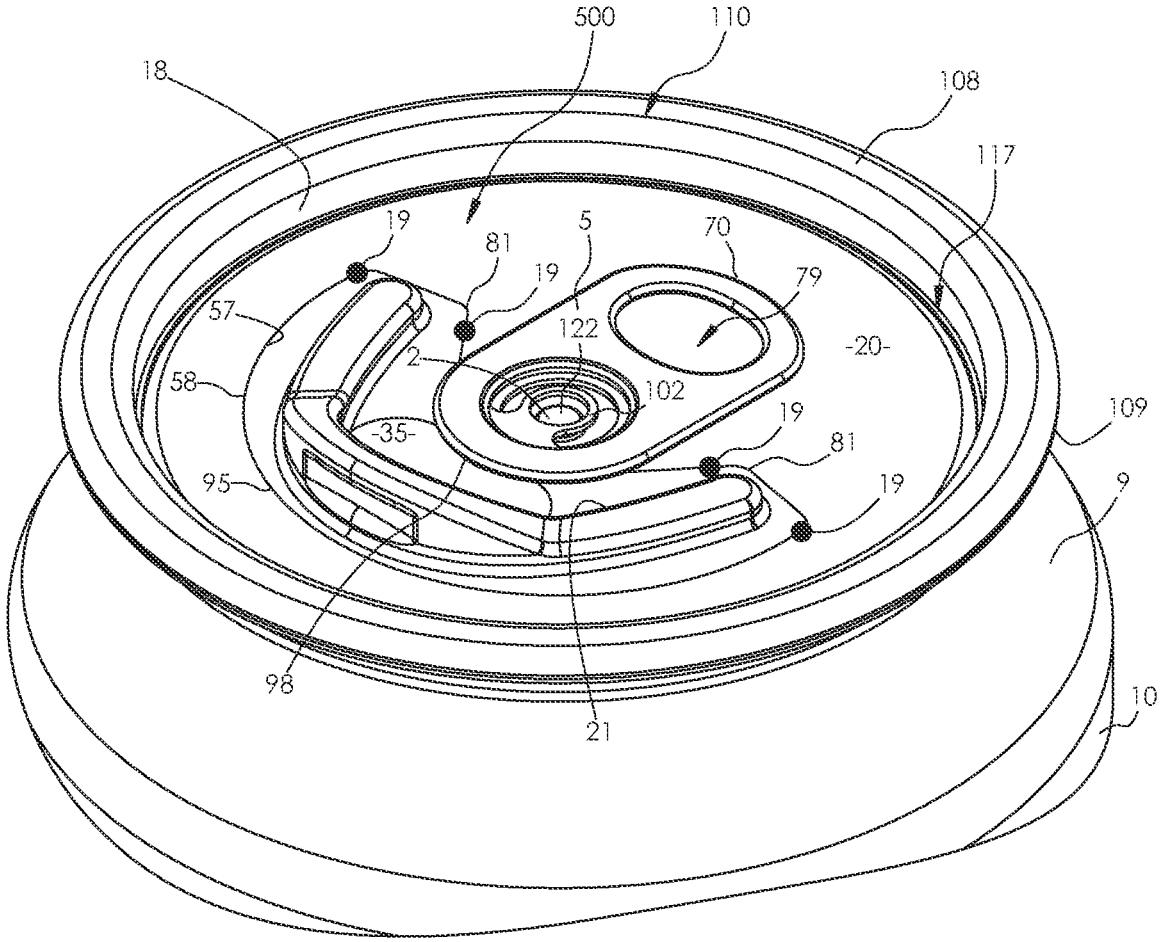
FIG. 22 is a top perspective view of the third alternative cap-lid ensemble according to the present invention resting within the neck of a fragmentary lower can body before final attachment thereto.
Figure 23:
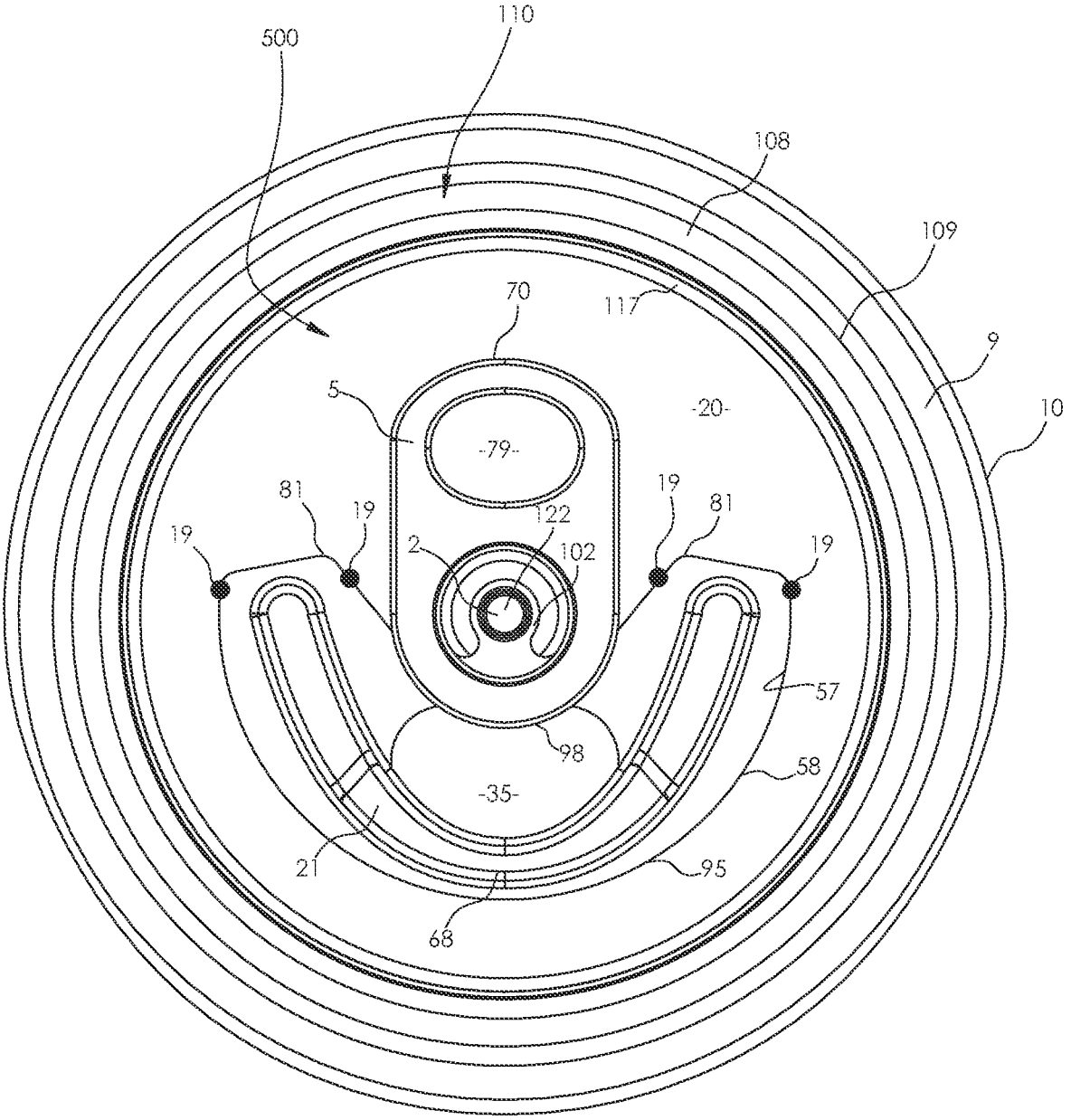
FIG. 23 is a top plan view of the third alternative cap-lid ensemble according to the present invention resting within the neck of a fragmentary lower can body before final attachment thereto.
Figure 23A:
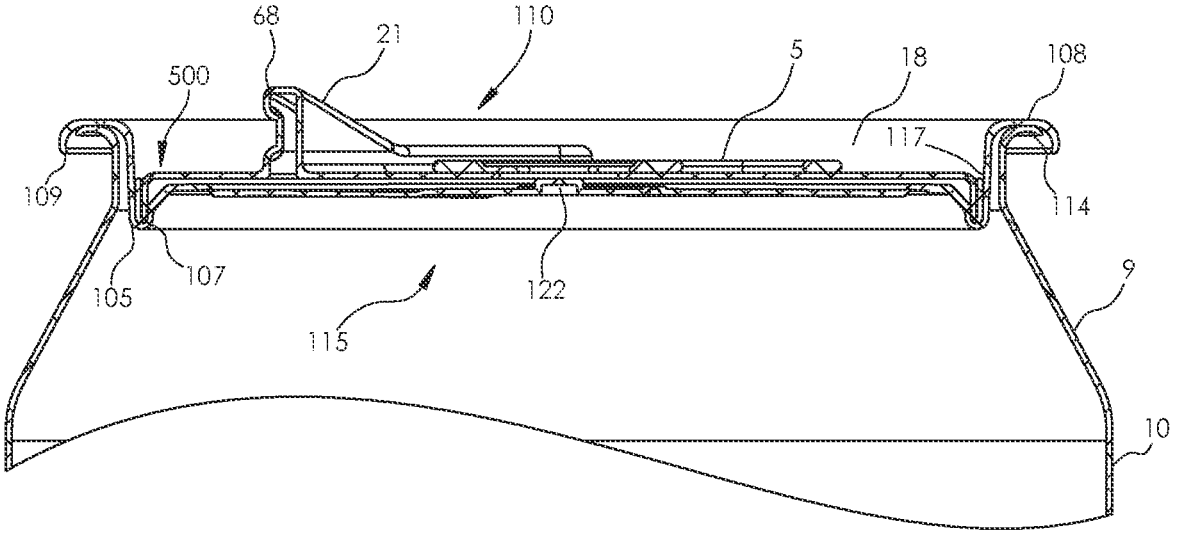
FIG. 23A is a longitudinal cross-sectional view as sectioned from FIG. 23 to show in greater detail the third alternative cap-lid ensemble according to the present invention resting within the neck of a fragmentary lower can body before final attachment thereto.
Figure 24:
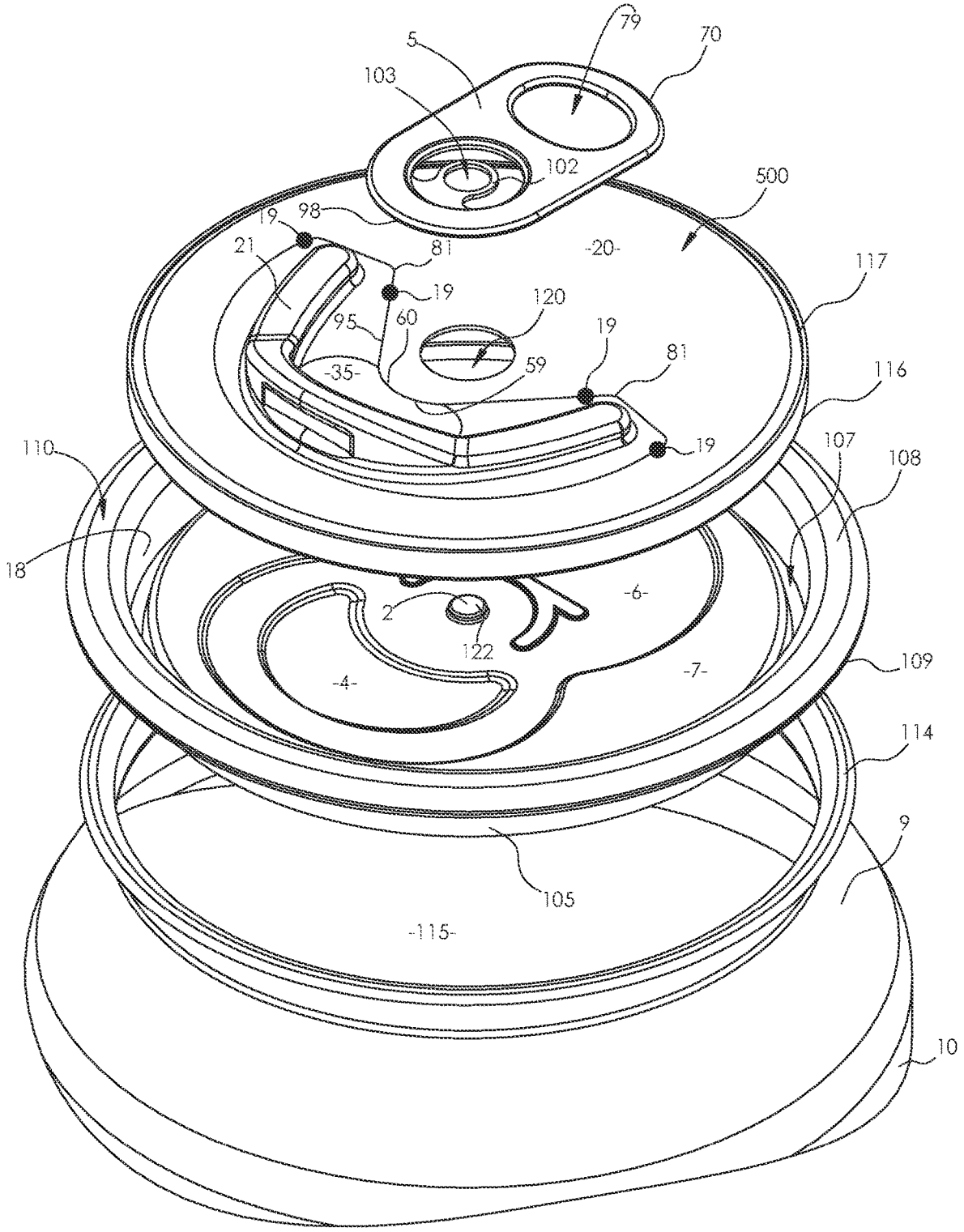
FIG. 24 is an exploded top perspective view of four components from bottom to top a fragmentary lower can body, a can body lid element, the third alternative lid cap according to the present invention, and a can lid opener element.

Comparatively referencing FIGS. 21 and 21A the reader will there consider how the plug depression 35 feature operates to plug the can opening 3. FIG. 21 depicts the plug depression 35 inserted into the can opening 3 for preventing container contents from exiting the lower can body 10 and from foreign contaminants from entering the lower can body 10. The reader will there note that the plug depression side walls 34 engage the edging 1 of the can opening 3. FIG. 21A depicts the can opening 3 being plugged by the plug depression 35 in broken lining. The plug depression 35 is removed from the can opining in solid lining in FIG. 21A.

The reader will note the two different structural locations of the edge at 58 when in the unplugged configuration and at edge 58' when in the plugged configuration. The lid cap 200 attaches to an upper container rim 8 as otherwise described in the '882 Application. FIG. 21B particularly highlights the score or perforation line 95 intermediate the edge 57 of the cap opening 50 and the outer edge 58 of the first pivot structure 21. The score or perforation line 95 is broken as a result of cut made in the preferably unibody material construction thereby forming a relatively tight fit and locking opposed edges 57 and 58 together when the outer edge 58 is pressed past back edge 57.

At the same time, the edge 59 of flange 61 meets the inner edge 60 of the first pivot structure 21. Edges 59 and 60 are also formed as a result of a cut through the preferred unibody material construction of all lid caps 400, 401, 200, and 500. Other features of the lid cap 200 include lower skirt edge 16 of a funnel skirt; side wall 22 of cap plate 20; laterally opposed structural levers 41; pivot points 42; side walls 43 of laterally opposed structural levers 41; back sides 45 of structural levers 42; lock depression 55; key structure 56; static structure 63; and edges 66 and 67 opposite score or perforation line 95 are all described in more detail in the '882 Application incorporated herein by reference thereto.

Referencing FIGS. 15-19A and 22-28 the reader will there consider the fourth alternative lid cap 500 according to the present invention. Specifically referencing FIGS. 18 and 19, the reader will there see a centrally located rivet-letting aperture 120 otherwise described as a fastener-letting aperture. The fastener-letting aperture 120 is central to the practice of the fourth alternative lid cap 500. Peripheral features as were taught by or described in connection with the first alternative lid cap 400 are also re-presented in lid cap 500, including the circumferential cap groove 117, the cap plate 20 located radially inwardly of the cap groove 117 and radially outwardly relative to the fastener-letting aperture 120; and the perforation or score line 95 intermediate opposed edges 57/58 and edges 59/60.

Further, recalling the third alternative lid cap 200, the reader will also note laterally opposed pairs of pivot points 19 or swinging structure hinges. The pivot axes of hinges 19 lie within a mid-lid hinge plane preferably and substantially dividing the anterior half of the lid cap(s) 500 (and 200) from the posterior half of the cap(s) 500 and (200). In the re-closeable cap 200, the swinging structure hinges 19 are preferably provided as two pairs of laterally opposed pivot points as discussed in more detail in connection with re-closeable cap 200. The reader will note that the swinging structure hinges 19 are depicted at dots or points 19. In other words, the swinging structure hinges 19 of the third and fourth alternative lid caps 200 and 500 are preferably pivot point. In the case of hinges 19, pivot points remain after the perimeter of the first pivot structure 21 defined by the score or perforation line 95 is cut or slit. The only spots or points not cut or slit are the pivot points 19 within the track of the line 95.

The reader will consider the tip or bend portion 81 adjacent the medial most pivot points 19 of the anterior or first cut line 95. The tip or bend portion 81 is intentionally formed as such in adjacency to the medial most pivot points 19 in order to create a novel "eccentric switch" as discussed in more detail in the '882 Application. The eccentric switch provided by tip or bend portion(s) 81 allows the first pivot structure 21 to be used as a "flip-flop" mechanism for maintaining a state of actuation by way of the inherent material resiliency of the material construction.

Though the foregoing features are important to lid cap 500, central to the practice of the fourth alternative embodiment is the fastener-letting aperture 120 through which aperture the rivet or fastener 122 extends and attaches the can opener element 5 in external or upper adjacency to the lid cap 500 such that the lid cap 500 is sandwiched intermediate the can opener element 5 and the lid capping plate 7 thereby helping to secure the lid cap 500 to the lid assembly 110. As with the lid cap 400, the circumferential cap groove 117 is mated with the circumferential lid groove 107 as previously described. The reader will, for example, note the adhesive layer or portion 111 referenced in FIG. 19A.

Figure 18:
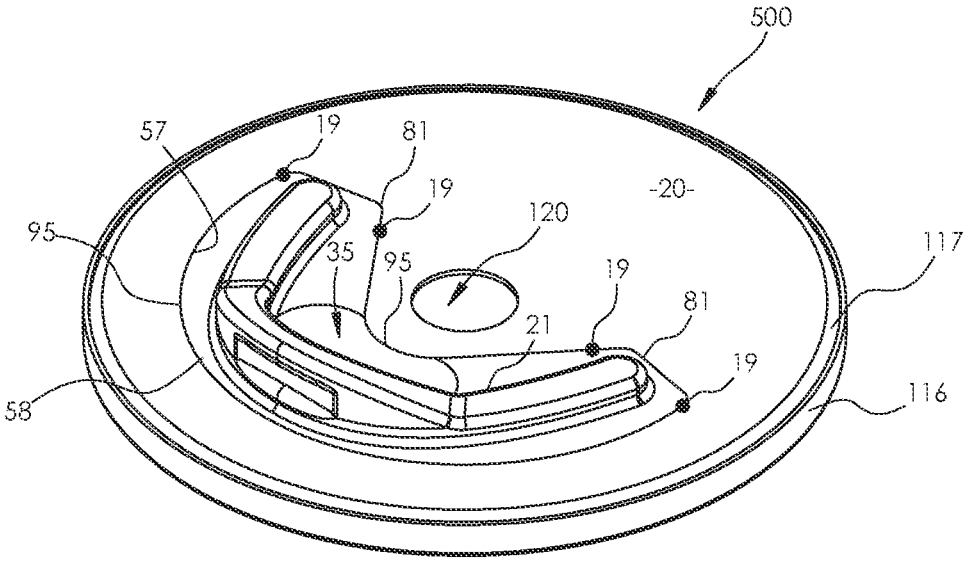
FIG. 18 is a top perspective view of a third alternative lid cap according to the present invention.
Figure 19:
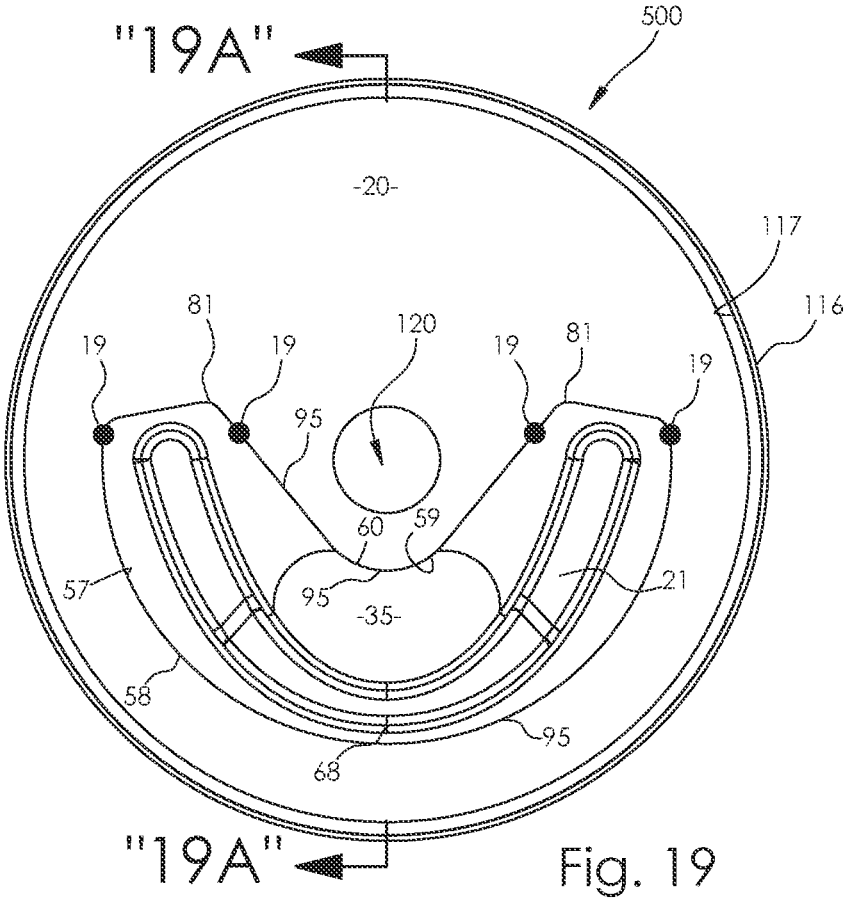
FIG. 19 is a top plan view of the third alternative lid cap according to the present invention.
Figure 19A:
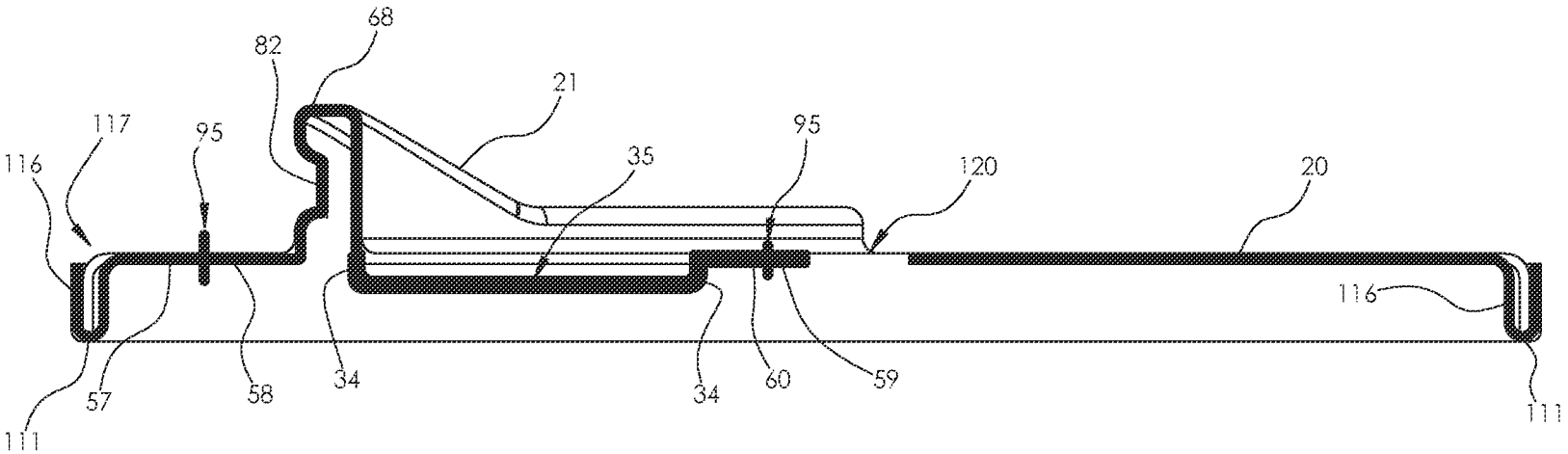
FIG. 19A is an enlarged longitudinal cross-sectional view as enlarged and sectioned from FIG. 19 to show in greater structural detail the third alternative lid cap according to the present invention.

Referencing FIG. 19, the reader will consider the re-closeable lid cap embodiment 500 with plug-enhanced flip-flop or first pivot structure 21. The diameter of fastener-letting aperture 120 is preferably greater than or equal to the diameter of the loop flange 102 to allow the loop flange 102 to fit through the aperture 120. The insertion of a relatively more compliant, resilient plastic material of the lid cap 500 underneath the flange 102 near the front edge of rivet 122 between hard aluminum material of the can opening plate 4 and can opener tip 98 helps ease can opening operations with less effort by the consumer. Further, comparatively referencing FIGS. 18, 22, and 24, the reader will there consider the lid cap 500 is made an integral part of the lid assembly 110 by partly attaching the lid cap 500 to the lid assembly 110 via the can opener element 5 and associated structures and partly attaching the lid cap 500 to the lid assembly via the mated engagement of the groove 117 and the groove 107.

FIGS. 25-28 depict a further enhancement or feature applicable to all lid caps made the subject of these specifications. The drawing content is thus largely diagrammatic to depict a reconfigurable portion 113 of the first pivot structure 21. The reconfigurable portion 113 is preferably formed from or comprises a resilient or elastic material for enabling the user to reconfigure the feature intermediate at least two utilitarian configurations. FIG. 25 is a diagrammatic depiction of an exemplary lid cap 500 with the reconfigurable portion 113 in a first relaxed raised state or configuration before the plate 4 is depressed to open the beverage can or form the can opening 3. This configuration enables the user to engage the groove 82 and pivot the first pivot structure 21 to form a cap opening. The reader will note the lid cap 500 is coupled between the lid capping plate 7 of the lid assembly 110 and the can opener element 5.

FIG. 25A is a second sequential depiction of the content otherwise shown in FIG. 25 to depict the lower can body 10 and outfitted lid assembly 110 being opened. The can opener element 5 is being pivoted at its pivot point and the edge 98 depresses the plate 4 to form the can opening 3. Simultaneously, the reconfigurable portion 113 is reconfigured by the edge 98 into an actuated second depressed configuration as at 113' for plugging the can opening 3. In other words, the reconfigurable portion 113 is converted or reconfigured to form a plug as at 113'. The reader will note space 84 below the edge 58 of the first pivot structure 21 in FIG. 25A.

FIG. 25B is a third sequential diagrammatic depiction of the structures otherwise depicted in FIGS. 25 and 25A showing the reconfigurable portion 113 as converted or reconfigured to a plug as at 113'. The first pivot structure 21 is pivoted about its pivot axis to disengage the plug 113' from the can opening 3 enabling the user to consume container contents. The first pivot structure 21 is thus in an open position or configuration and the converted plug feature 113' provides an envelope 123 over the edge 98 and end portions of the can opener element 5. FIG. 26C is a fourth sequential diagrammatic depiction of the content previously illustrated with the first pivot structure 21 being returned to a plugging configuration for plugging the can opening 3. The reader will note that when the first pivot structure 21 is so returned to the plugged configuration, the edge 58 snaps under edge 57 within the space 84 thereby securing the plug 113' in the plugged configuration.

FIGS. 26-28 further depict certain diagrammatic applications of the lid caps exemplified by the lid cap 500 according to the present invention and stemming from the reconfigurability of the reconfigurable portion 113 of the first pivot structure 21. FIG. 26 is a diagrammatic depiction of the reconfigurable portion with a material thickness as at 119 and in a first relaxed raised state or configuration with height A. FIG. 27 depicts the reconfigurable portion being actuated via generic press plates 121 into a collapsed configuration along predetermine fold lines effectively rendering the collapsed height of the reconfigurable portion of the collapsed lid cap 500' roughly 3 times the material thickness 119 significantly lesser than height A as more clearly depicted in FIG. 27A. FIG. 28 depicts the press plates 121 removed from the collapsed lid cap 500" whereafter the inherent resilience of the material construction operates to return the reconfigurable portion to a second relaxed raised height "A-" lesser than height A.

Figure 15:
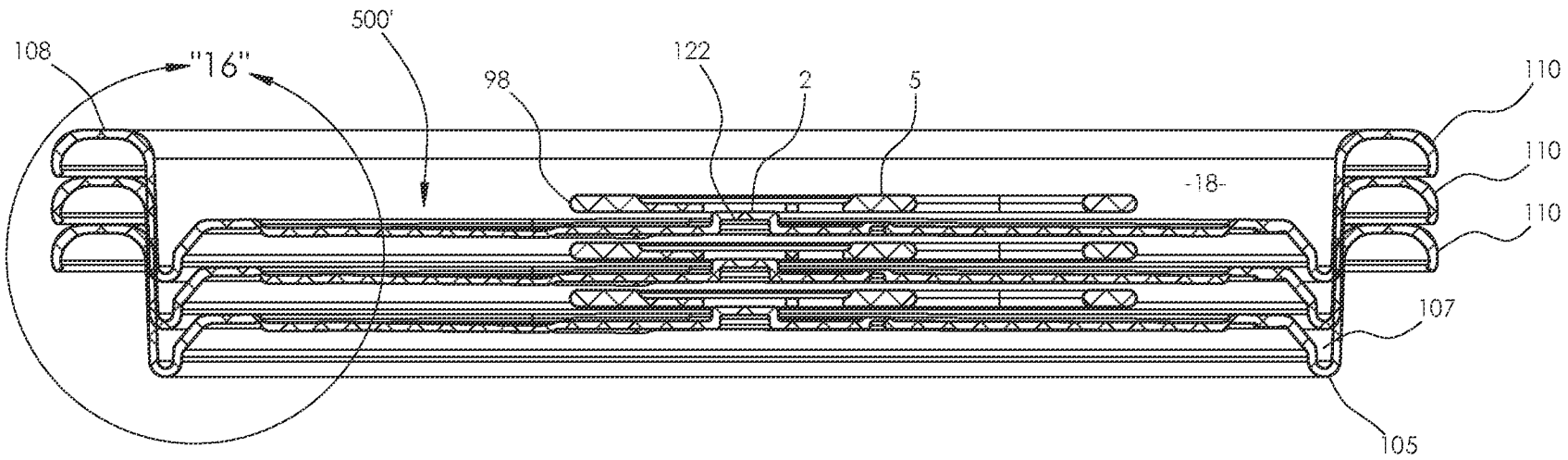
FIG. 15 is an enlarged longitudinal cross-sectional view of a series of stacked third alternative lid-cap ensembles.
Figure 16:
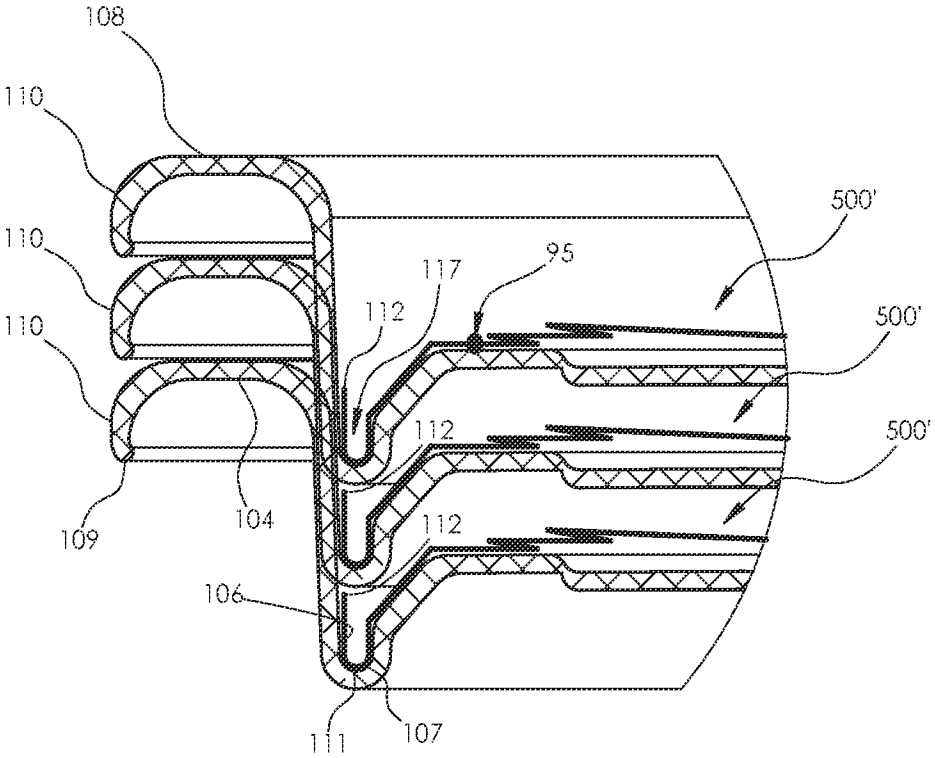
FIG. 16 is an enlarged fragmentary sectional view as enlarged and sectioned from FIG. 15 to show in greater detail a series of third alternative lid caps in assembled relation with a series of lid assemblies.
Figure 17:
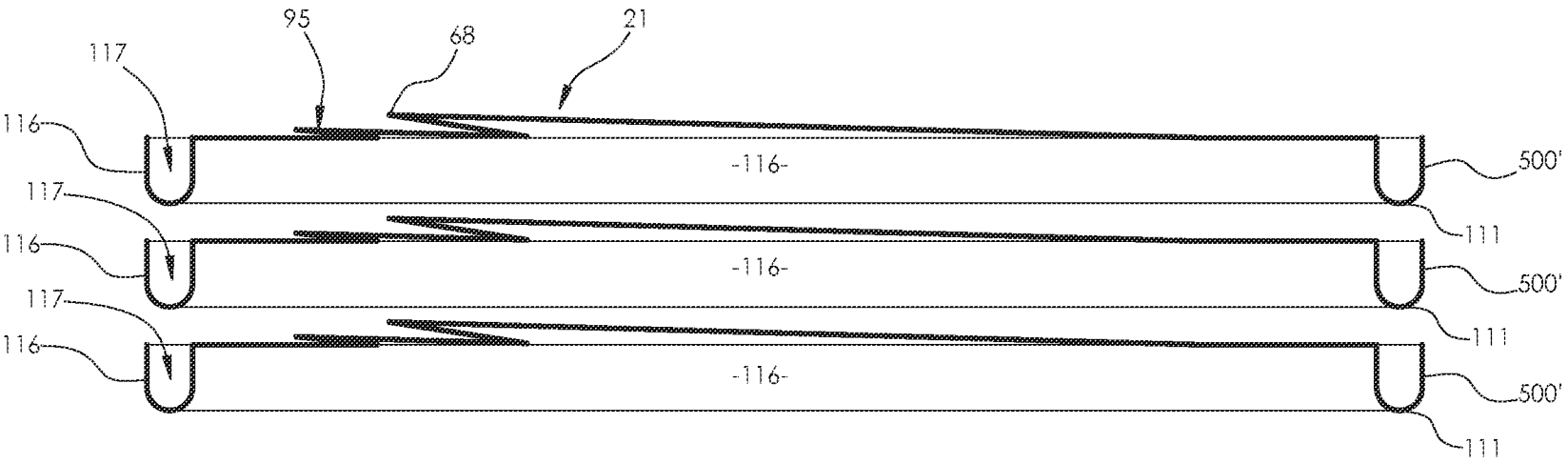
FIG. 17 is a schematic depiction of a series of third alternative lid caps in collapsed configurations for reducing volumetric space when stacked as otherwise comparatively depicted in FIGS. 15 and 16.

Referencing FIGS. 15-17, the reader will there consider further features enabled by the collapsible reconfigurable portion 113. In this regard, it is contemplated that the lid assemblies 110 may be nestedly stacked and when lid caps 500 are integrally assembled therewith, the collapsible reconfigurable portions 113, reduced in volume, may occupy space intermediate successively stacked lid assemblies 110 as generally and comparatively depicted in FIGS. 16 and 17. In this regard, the circumferential cap grooves 117 terminate outwardly by upwardly extending terminal edges 112. The terminal edges 112 function to structurally space and support nested upper lid-cap combinations as generally depicted in FIG. 16.

Referencing FIG. 16, the reader will there consider the depicted re-closeable lid caps 500' integrally assembled with lid assemblies 110 in stacked relation with one another and implementing the directional collapsing method described hereinabove. Note: the re-closeable lid cap embodiment 500' is the version of lid cap embodiment 500 with pressed/collapsed reconfigurable portion 113 to reduce volumetric space occupied thereby and to enhance stacking of upper can ends or lid assemblies 110 as outfitted with the re-closeable lid caps 500'. The spacing between upper can ends in stacked relation is generally greater than the thickness of collapsed thermoformed structures using thing flexible, resilient material.

The lid cap embodiments 400 and 401 provide re-closeable lid caps that couple with an upper can end at the lid assembly 110 after the can opener element 5 is affixed to the lid capping plate 7 of the lid assembly 110 via a rivet 122. In other words, after the lid assembly 110 is produced by the manufacturer, the re-closeable lid caps 400 and 401 may be coupled with or outfitted upon a lid assembly 110 before being affixed to a lower can body 10 or may be affixed to a lid assembly 110 after the lid assembly 110 is affixed to a lower can body 10.

In either construction, the lid cap embodiments 400 and 401 allow some flexibility as to which party may couple re-closeable caps with an upper can end or lid assembly 110, whether the party is a manufacturer, a beverage packaging company or by third party. Consumers would not normally be responsible for affixing the lid caps 400 or 401 to the lid assemblies 110. The lid caps 400 and 401 differ from previously discussed embodiments (e.g. embodiments 100, 200, and 300 of the '882 Application) mostly by way of how the re-closeable lid caps 400 and 401 are secured to the upper can end or lid assembly 110 in order to significantly increase efficiency of packaging methods and lower price of beverage cans outfitted with re-closeable caps.

In this regard, the lid caps 400 and 401 allow beverage packaging companies to outfit beverage cans with re-closeable caps without necessitating significant changes to current beverage packaging methods. The lid caps 400 and 401 according to the present invention make it possible to provide upper can ends or lid assemblies 110 already outfitted with re-closeable caps allowing the beverage packaging companies to outfit beverage cans after beverage is dispensed thereinto without significant changes in currently used methods and beverage packaging equipment.

The lid cap embodiment 500 goes one step further and couples the re-closeable lid cap with an upper can end or lid capping plate 7 before the can opener element 5 is affixed to the lid assembly 110. As a result, the lid cap 500 is attached to a beverage can between the lid capping plate 7 and can opener element 5. Because the lid cap embodiment 500 is affixed to the lid capping plate before the can opener element 5, the assembly is preferably performed by the manufacturer of upper can ends or lid assemblies 110.

Other features of note include the provision of the plug-like depression that acts as a plug 35 for the can opening 3, which plug-like depression or feature is integrally made part of the first pivot structure or flip-flop structure 21. Further, this application teaches a way of enhancing performance or utilitarian aspects of thermoformed structures by pressing/collapsing already thermoformed parts directionally collapsing flexible material in order to form finer structural details otherwise impossible to make by thermoforming processes. These types of details may include deep or sharp undercuts, spring like-accordion and zig-zagged structures etc. Further, the feature enhances stacking of the product, gripping abilities and other functions of the final product.

These specifications further support the concept of directional collapsing of the prepositioned thermoformed structures into different structures for purpose of enhancing performance of the product in different stages of its use. That method utilized flexibility, resistivity, internal memory and other qualities of the materials and difference in structural strength of materials such as aluminum and plastic to achieve desirable effect as generally demonstrated in FIGS. 25-25C.

While the above descriptions contain much specificity, this specificity should not be construed as limitations on the scope of the invention, but rather as an exemplification of the invention. In certain embodiments, the basic invention may be said to essentially teach or disclose a lid cap or lid-cap combination when integrally formed with or fixedly attached to a lid assembly of a beverage can. In this regard, it will be recalled the various lid cap embodiments described hereinabove are configured to outfit a lid assembly of a beverage can or a lid assembly that is attachable to a lower can body. The lid assembly usable in combination with the various lid caps essentially comprises a lid rim or lid rim portion as at 108, a lid capping plate as at 7, and a lid groove as at 107 intermediate the lid rim and the lid capping plate.

From a first perspective, the various lid caps according to the present invention may be fairly said to essentially comprise a cap groove as at 117 and a cap plate as at 20. The cap plate is centrally located relative to the cap groove, which cap groove is configured for attaching the lid cap to the lid assembly by mated engagement. The cap plate further preferably comprises a pivot structure as at 21. The pivot structure is pivotal for selectively providing a can-opening access aperture and selectively closing the can-opening access aperture. The can-opening access aperture enables a user to consume can contents by way of a can opening formed in the lid capping plate.

In certain lid cap embodiments, the cap groove is configured for mated insertion into the lid groove for attaching the lid cap to the lid assembly. This is the case for lid caps 400 and 500, for example. The lid cap 500, in particular, may preferably also comprise a fastener-letting aperture as at 120. The lid cap 500 may be attached to the lid capping plate via the can opener element and a fastener (e.g. rivet 122) as extended through the fastener-letting aperture.

In certain iterations, an adhesive layer or adhesive portion may be provided intermediate the lid groove and the cap groove for fixedly attaching the lid cap to the lid assembly thereby forming a lid-cap combination. The adhesive may be of a heat-treatable type and may be set in combination with pressure applications. In this regard, it will be further recalled that the cap groove may be alternatively mechanically pressed into the lid groove via a tight structural engagement for fixedly attaching the lid cap to the lid assembly and forming a lid-cap combination.

From a second perspective, the present invention may be said to essentially provide a lid-cap combination for lidding-capping a lower can body as at 10. In this regard, the lower can body is lidded with a lid assembly by state-of-the-art methods, and the lid assembly as described is outfitted or capped with a lid cap as various exemplified. The lid-cap combination incorporating lid cap 500 may be said to essentially comprise a lid assembly and a lid cap. The lid assembly may be said to essentially comprise a lid rim portion, a lid capping plate, and a can opener element. The lid rim portion is attachable to a lower can body for lidding the lower can body.

The lid cap essentially comprises a cap plate centrally located relative to an outer cap periphery, which cap plate essentially comprises a fastener-letting aperture. The can opener element is attached to the lid capping plate via a fastener as extended through the fastener-letting aperture thereby sandwiching the cap plate intermediate the can opener element and the lid capping plate for firstly attaching the lid cap to the lid assembly. Noting that the lid assembly comprises a lid groove intermediate the lid rim portion and the lid capping plate, the lid cap may further preferably comprise a cap groove inwardly adjacent the outer cap periphery, which cap groove is configured for mated insertion into the lid groove for secondly attaching the lid cap to the lid assembly.

The cap plate may further preferably comprise a pivot structure for selectively providing a can-opening access aperture and selectively closing the can-opening access aperture. The can-opening access aperture enables a user to consume can contents by way of a can opening formed in the lid capping plate via the can opener element and the pivot structure. The pivot structure may preferably comprise a reconfigurable portion as at 113. The reconfigurable portion, being formed from or comprising a resilient or elastic material, is resiliently actuable intermediate at least two utilitarian configurations.

In a first aspect, the reconfigurable portion is resiliently actuable intermediate a first relaxed raised configuration and an actuated collapsed configuration. The first relaxed raised configuration enables a user to more easily manually pivot the pivot structure whereas the actuated collapsed configuration reduces volumetric space occupied by the reconfigurable portion (e.g. for packaging purposes). The cap groove may preferably comprise an outer groove terminal edge as at 112. The lid-cap combination is preferably nestable with a series of successive substantially identical lid-cap combinations such that the outer groove terminal edge(s) of lower lid-cap combinations space and support nested upper lid-cap combinations. The outer groove terminal edges of lower lid-cap combinations space nested upper lid-cap combinations for accommodating the actuated collapsed configurations of the reconfigurable portions.

In a second aspect, the internal resilience of the reconfigurable portion is operable to return the reconfigurable portion toward the first relaxed raised configuration when a collapsing force is removed therefrom. In this regard, the internal resilience of the reconfigurable portion is operable to return the reconfigurable portion to a second relaxed raised configuration when the collapsing force is removed therefrom, which second relaxed raised configuration is of a lesser raised height as compared to the first relaxed raised configuration. This feature provides packaging companies to modify packaging protocols, as discussed hereinabove. The reconfigurable portion is further preferably resiliently actuable intermediate an upwardly extending configuration and a downwardly extending configuration, which downwardly extending configuration is configured to selectively plug the can opening.

What is claimed is:

1. A lid cap, the lid cap being configured to outfit a lid assembly of a beverage can, the lid assembly comprising a lid rim, a lid capping plate, a lid groove intermediate the lid rim and the lid capping plate, and a can opener element, the lid cap comprising:

a cap groove, a cap plate centrally located relative to the cap groove, and a fastener-letting aperture, the cap groove being configured for attaching the lid cap to the lid assembly by mated engagement, the lid cap being attached to the lid capping plate via the can opener element and a fastener extending through the fastener-letting aperture, the cap plate comprising a pivot structure, the pivot structure being pivotal for selectively providing a can-opening access aperture and selectively closing the can-opening access aperture, the can-opening access aperture for enabling a user to consume can contents by way of a can opening formed in the lid capping plate.

2. The lid cap of claim 1 wherein the cap groove is configured for insertion into the lid groove for attaching the lid cap to the lid assembly.

3. The lid cap of claim 2 wherein an adhesive is provided intermediate the lid groove and the cap groove for fixedly attaching the lid cap to the lid assembly thereby forming a lid-cap combination.

4. The lid cap of claim 2 wherein the cap groove is mechanically pressed into the lid groove for fixedly attaching the lid cap to the lid assembly thereby forming a lid-cap combination.

5. A lid-cap combination for lidding-capping a lower can body, the lid-cap combination comprising:

a lid assembly, the lid assembly comprising a lid rim portion, a lid capping plate, and a can opener element, the lid rim portion being attachable to a lower can body for lidding the lower can body; and a lid cap, the lid cap comprising a cap plate centrally located relative to an outer cap periphery, the cap plate comprising a fastener-letting aperture, the can opener element being attached to the lid capping plate via the fastener-letting aperture thereby sandwiching the cap plate intermediate the can opener element and the lid capping plate for firstly attaching the lid cap to the lid assembly;

the cap plate comprising a pivot structure, the pivot structure being pivotal for selectively providing a can-opening access aperture and selectively closing the can-opening access aperture, the can-opening access aperture for enabling a user to consume can contents by way of a can opening formed in the lid capping plate via the can opener element and the pivot structure;

the pivot structure comprising a reconfigurable portion, the reconfigurable portion being resiliently actuable intermediate at least two utilitarian configurations, including a first relaxed raised configuration and an actuated collapsed configuration, the first relaxed raised configuration for enabling a user to manually pivot the pivot structure, the actuated collapsed configuration for reducing volumetric space occupied by the reconfigurable portion.

6. The lid-cap combination of claim 5 wherein the lid assembly comprises a lid groove intermediate the lid rim portion and the lid capping plate and the lid cap comprises a cap groove inwardly adjacent the outer cap periphery, the cap groove being configured for insertion into the lid groove for secondly attaching the lid cap to the lid assembly.

7. The lid-cap combination of claim 6 wherein the cap groove comprises an outer groove terminal edge, the lid-cap combination being nestable with a series of successive substantially identical lid-cap combinations, the outer groove terminal edge of lower lid-cap combinations for spacing and supporting nested upper lid-cap combinations.

8. The lid-cap combination of claim 5 wherein the reconfigurable portion is resiliently actuable intermediate an upwardly extending configuration and a downwardly extending configuration.

9. The lid-cap combination of claim 8 wherein the downwardly extending configuration is configured to selectively plug the can opening.

10. A lid cap for outfitting a lid assembly of a beverage can, the lid assembly comprising a lid capping plate and a can opener element, the lid cap comprising a cap plate and a pivot structure, the cap plate being centrally located relative to an outer cap periphery, the cap plate comprising a fastener-letting aperture, the can opener element being attached to the lid capping plate via the fastener-letting aperture thereby sandwiching the cap plate intermediate the can opener element and the lid capping plate for firstly attaching the lid cap to the lid assembly;

the pivot structure being pivotal for selectively providing a can-opening access aperture and selectively closing the can-opening access aperture, the can-opening access aperture for enabling a user to consume can contents by way of a can opening formed in the lid capping plate via the can opener element and the pivot structure;

the pivot structure comprising a reconfigurable portion, the reconfigurable portion being resiliently actuable intermediate at least two utilitarian configurations including an upwardly extending configuration and a downwardly extending configuration.

11. The lid cap of claim 10 wherein the reconfigurable portion is resiliently actuable intermediate a first relaxed raised configuration and an actuated collapsed configuration, the first relaxed raised configuration for enabling a user to manually pivot the pivotal portion, the actuated collapsed configuration for reducing volumetric space occupied by the reconfigurable portion.

12. The lid cap of claim 10 wherein the downwardly extending configuration is configured to selectively plug the can opening.

13. The lid cap of claim 10 comprising a cap groove inwardly adjacent the outer cap periphery, the cap groove being configured for mated engagement with the lid assembly for secondly attaching the lid cap thereto.

14. A lid cap for outfitting a lid assembly of a beverage can, the lid assembly comprising a lid capping plate and a can opener element, the lid cap comprising:

a cap plate and a pivot structure, the pivot structure being pivotal for selectively providing a can-opening access aperture and selectively closing the can-opening access aperture, the can-opening access aperture for enabling a user to consume can contents by way of a can opening formed in the lid capping plate via the can opener element and the pivot structure;

the pivot structure comprising an eccentric switch mechanism, the eccentric switch mechanism comprising laterally opposed pairs of pivot points and a resilient bend portion intermediate each pair of pivot points, the resilient bend portions being resiliently actuable and engageable with laterally opposed portions of the cap plate for maintaining a state of actuation.

* * * * *